US008826558B2

(12) United States Patent
Priebe et al.

(10) Patent No.: US 8,826,558 B2
(45) Date of Patent: Sep. 9, 2014

(54) BARRIER DRYER TRANSPORTING MEDIUM THROUGH HEATING LIQUID

(71) Applicants: Alan Richard Priebe, Rochester, NY (US); Donald Saul Rimai, Webster, NY (US); Christopher J. White, Avon, NY (US)

(72) Inventors: Alan Richard Priebe, Rochester, NY (US); Donald Saul Rimai, Webster, NY (US); Christopher J. White, Avon, NY (US)

(73) Assignee: Eastman Kodak Company, Rochester, NY (US)

( * ) Notice: Subject to any disclaimer, the term of this patent is extended or adjusted under 35 U.S.C. 154(b) by 50 days.

(21) Appl. No.: 13/649,146

(22) Filed: Oct. 11, 2012

(65) Prior Publication Data

US 2014/0101957 A1 Apr. 17, 2014

(51) Int. Cl.
*F26B 19/00* (2006.01)

(52) U.S. Cl.
USPC ..... 34/60; 34/78; 34/90; 118/258; 347/102; 430/62

(58) Field of Classification Search
USPC ..... 34/60, 70, 77, 78, 80, 90; 118/258; 347/102, 103, 104, 105; 430/60, 62
See application file for complete search history.

(56) References Cited

U.S. PATENT DOCUMENTS

| | | | | |
|---|---|---|---|---|
| 4,313,899 | A * | 2/1982 | Hain | 264/40.1 |
| 4,636,808 | A | 1/1987 | Herron | |
| 4,654,980 | A | 4/1987 | Bhat | |
| 4,943,816 | A | 7/1990 | Sporer | |
| 5,172,709 | A | 12/1992 | Eckhardt et al. | |
| 5,594,540 | A | 1/1997 | Higaya et al. | |
| 5,678,157 | A * | 10/1997 | Yoshida et al. | 399/390 |
| 6,309,463 | B1 | 10/2001 | Hess et al. | |
| 6,588,888 | B2 | 7/2003 | Jeanmaire et al. | |
| 6,625,901 | B1 * | 9/2003 | Mehmandoust et al. | 34/476 |
| 6,851,796 | B2 | 2/2005 | Jeanmaire et al. | |
| 7,350,902 | B2 | 4/2008 | Dietl et al. | |
| 7,405,027 | B2 * | 7/2008 | Chou et al. | 430/137.15 |
| 7,697,877 | B2 | 4/2010 | Asakura et al. | |
| 8,136,909 | B2 * | 3/2012 | Ogasawara et al. | 347/18 |
| 8,240,808 | B2 * | 8/2012 | Sasayama | 347/30 |
| 8,251,505 | B2 | 8/2012 | Hara | |
| 8,567,938 | B2 * | 10/2013 | Tombs et al. | 347/102 |
| 8,684,514 | B1 * | 4/2014 | Priebe et al. | 347/102 |
| 8,690,312 | B2 * | 4/2014 | Tombs et al. | 347/102 |
| 2007/0245591 | A1 * | 10/2007 | Gens et al. | 34/443 |

(Continued)

FOREIGN PATENT DOCUMENTS

| | | | |
|---|---|---|---|
| EP | 267754 | * | 12/2013 |
| WO | WO2012112599 | * | 8/2012 |

*Primary Examiner* — Steve M Gravini
(74) *Attorney, Agent, or Firm* — Kevin E. Spaulding

(57) ABSTRACT

A media drying system removes a moistening liquid from a moistened medium having first and second surfaces. A liquid reservoir contains a heating liquid heated above a moistening-liquid boiling point. A rotatable liquid-blocking member has a liquid-blocking layer with an inner surface and an outer surface. A media-transport system transports the medium entrained around the liquid-blocking member so that the first surface of the moistened medium is brought into contact with the outer surface of the liquid-blocking layer. An entrained portion of the moistened medium passes through the liquid reservoir and is submerged in the warmed heating liquid. The heating liquid contacts the inner surface of the liquid-blocking layer so that heat is transferred through the liquid-blocking layer from the warmed heating liquid to the moistening liquid, or heat is transferred from the warmed heating liquid to the second surface of the moistened medium.

16 Claims, 13 Drawing Sheets

(56) References Cited

U.S. PATENT DOCUMENTS

2010/0192851 A1* 8/2010 Shah et al. ..... 118/620
2011/0267390 A1* 11/2011 Bulovic et al. ..... 347/9
2014/0101957 A1* 4/2014 Priebe et al. ..... 34/60
2014/0101958 A1* 4/2014 Priebe et al. ..... 34/60
2014/0101959 A1* 4/2014 Priebe et al. ..... 34/60
2014/0101968 A1* 4/2014 Priebe et al. ..... 34/519
2014/0104354 A1* 4/2014 Priebe et al. ..... 347/102

* cited by examiner

FIG. 11
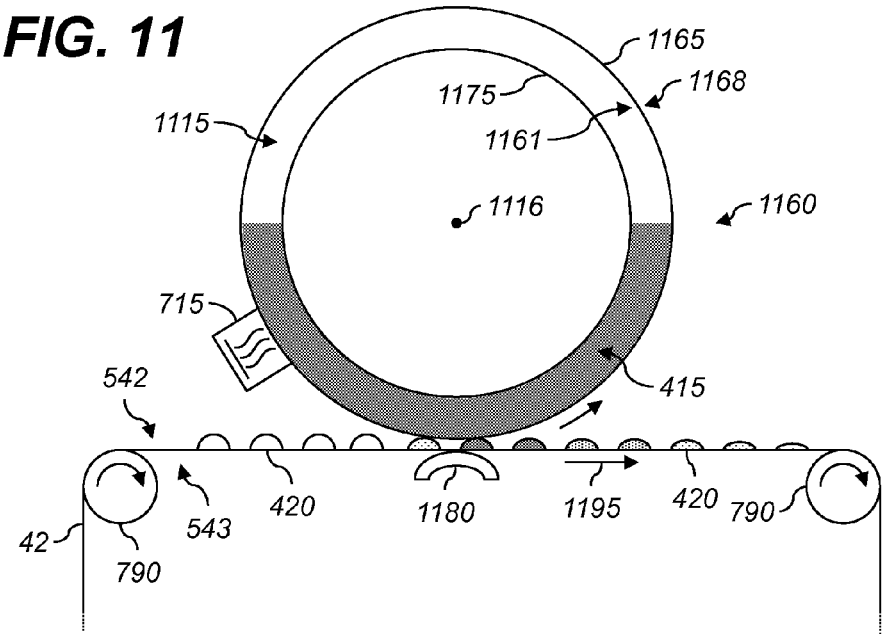
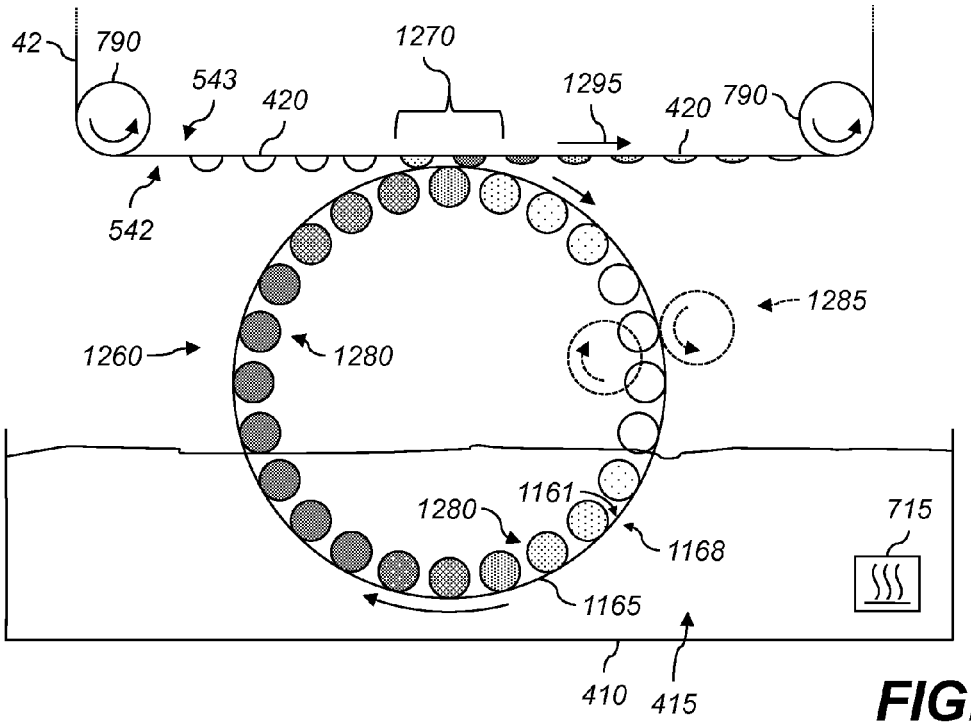
FIG. 12

BARRIER DRYER TRANSPORTING MEDIUM THROUGH HEATING LIQUID

CROSS-REFERENCE TO RELATED APPLICATIONS

Reference is made to commonly assigned, co-pending U.S. patent application Ser. No. 13/649,134, entitled: "Applying heating liquid to remove moistening liquid", by Priebe et al.; to commonly assigned, co-pending U.S. patent application Ser. No. 13/649,139, entitled: "Dryer transporting moistened medium through heating liquid", by Priebe et al.; to commonly assigned, co-pending U.S. patent application Ser. No.13/649,141, entitled: "Dryer impinging heating liquid onto moistened medium", by Priebe et al.; to commonly assigned, co-pending U.S. patent application Ser. No. 13/649, 143, entitled: "Removing moistening liquid using heating-liquid barrier", by Priebe et al.; to commonly assigned, co-pending U.S. patent application Ser. No. 13/649,152, entitled: "Dryer with heating liquid in cavity", by Priebe et al.; to commonly assigned, co-pending U.S. patent application Ser. No. 13/649,158, entitled: "Barrier dryer with porous liquid-carrying material", by Priebe et al.; and to commonly assigned, co-pending U.S. patent application Ser. No. 13/649, 167, entitled: "Dryer impinging heating liquid onto barrier", by Priebe et al., each of which is incorporated herein by reference.

FIELD OF THE INVENTION

This invention pertains to the field of media drying, especially in printing systems.

BACKGROUND OF THE INVENTION

Printers generally apply marking substances (e.g., inks) to receivers (e.g., paper). Inks used in inkjet printers are generally hydrophilic, and include a solute (e.g., pigment particles or dye molecules) dissolved or suspended in an ink solvent (e.g., water). The solvent in an ink needs to be removed to form a permanent image. Moreover, the solvent can soak into a receiver, causing the receiver to lose strength or mechanically deform. The solvent's soaking into a receiver, especially a fibrous receiver such as paper, can also reduce image quality by reducing effective resolution (because the ink spreads) and reducing density (the color of the fibers can show through as the ink soaks in to the receiver). It is therefore desirable to dry the ink rapidly to reduce absorption of the ink into the marked receiver. Drying can remove solvent dissolved into the receiver, or remove solvent from ink drops that have not yet permeated or dissolved into the receiver. In many printers, drying is the step that determines the speed at which a printer can operate. It is therefore desirable to dry as quickly as possible to increase printer productivity.

Various schemes have been described for drying inks on a marked receiver. Many dryers blow hot air across a wet image on a receiver. However, air has a low heat capacity, which limits its ability to transfer heat. Moreover, the hot air transfers heat not just to the ink, where the heat is desired, but also to the receiver. This failure to concentrate the applied heat can slow down the drying process. It is also desirable to keep the temperature of paper receivers low, limiting the thermal power that can be applied. Moreover, blowing hot air can smear the ink that is either being jetted or is on the receiver, thereby degrading the image.

Other schemes include irradiating the marked receiver (e.g., with infrared or microwave radiation). However, in order to avoid excessive heat absorption in the receiver, the frequency must be carefully chosen. Moreover, many receivers contain some water under normal conditions, as atmospheric moisture falls down its concentration gradient into dry porous or semi-porous sheets. Accordingly, it may not be possible to heat the ink without also heating the receiver.

Furthermore, drying different areas of a receiver at different rates can result in wrinkling or distortion of the receiver. These problems can worsen as the speed of drying increases, or when the receiver is locked in place (e.g., in a nip) while drying. Various schemes require drying parameters be adjusted according to the type of media used (e.g., coated vs. uncoated paper). Moreover, the moisture released during drying can condense on surfaces in a printer. Drying can also cause paper, especially semi-porous paper, to blister: water within the paper can vaporize, creating sufficient pressure to disrupt the surface of the paper.

Various ways of removing substances from receivers have been described. U.S. Pat. No. 4,654,980 to Bhat, entitled "Solvent removal using a condensable heat transfer vapor," describes removing non-aqueous solvents from a receiver by applying a countercurrent of saturated steam. U.S. Pat. No. 5,172,709 to Eckhardt et al., entitled "Apparatus and process for removing contaminants from soil," describes removing contaminants (e.g., oils or heavy metals) from a substrate material (e.g., soil) using a hot pressurized liquid (e.g., steam). However, these schemes use water to remove non-water. Inkjet drying involves removing water or another aqueous solvent while retaining the non-water. These schemes are therefore unsuitable for inkjet drying.

Various schemes have also been described to improve the application of material to receivers. Some schemes using purpose-made coated inkjet papers to improve drying performance. However, these schemes inherently limit the types of paper that can be used, and coated inkjet papers are generally more expensive than standard commercial papers. U.S. Pat. No. 6,309,463 to Hess et al., entitled "Device for direct or indirect application of liquid or viscous coating medium onto a moving material web," deliberately moistens a material to permit a coating to smooth and bond more effectively to the material. This can include directing hot liquid vapor towards the paper. However, drying involves removing moisture, not adding it. Causing coating material to adhere more effectively to a substrate does not assist with removal of moisture from that substrate.

U.S. Pat. No. 4,943,816 to Sporer, entitled "High quality thermal jet printer configuration suitable for producing color images," discloses the use of a marking fluid containing no dye so that a latent image in the form of fluid drops is formed on a piece of paper. The marking fluid is relatively non-wetting to the paper. Sporer teaches the use of a 300 dpi thermal inkjet printer to produce the latent image. Surface tension then causes colored powder to adhere to the fluid drops. Sporer teaches that only that portion of the droplet that has not penetrated or feathered into the paper is available for attracting dry ink, so this process is unsuitable for highly-absorbent papers such as newsprint. Moreover, this process does not remove moisture from the receiver, so drying can still be required. Also, this process is a hybrid of inkjet and powder printing, so is not suitable for use in conventional inkjet printers.

There is, therefore, a continuing need for ways of removing moisture from receivers, e.g., to permit producing high-quality images at high speed using inkjet printers.

SUMMARY OF THE INVENTION

According to an aspect of the present invention, there is provided a media drying system for removing a moistening liquid from a moistened medium having a first surface and a second surface, the moistening liquid having a moistening-liquid boiling point, comprising:

a liquid reservoir containing a heating liquid;

a liquid-heating system for warming the heating liquid in the liquid reservoir to a temperature greater than the moistening-liquid boiling point;

a rotatable liquid-blocking member having a liquid-blocking layer with an inner surface and an outer surface; and a media-transport system for transporting the moistened medium along a transport path in which the moistened medium is entrained around the liquid-blocking member so that the first surface of the moistened medium is brought into contact with the outer surface of the liquid-blocking layer;

wherein the liquid-blocking member and the liquid reservoir are arranged so that an entrained portion of the moistened medium passes through the liquid reservoir, whereby the entrained portion is submerged in the warmed heating liquid bringing the heating liquid into contact with the inner surface of the liquid-blocking layer, such that heat is transferred through the liquid-blocking layer from the warmed heating liquid to the moistening liquid, or heat is transferred from the warmed heating liquid to the second surface of the moistened medium, thereby vaporizing the moistening liquid and removing it from the moistened medium.

An advantage of the present invention is that it effectively removes moistening liquid from a moistened medium. Using a heating liquid can provide a higher thermal power than using a heated gas. Using a liquid-blocking barrier reduces the probability of image damage, and permits using heating liquids that are miscible with the moistening liquid. The heat is applied primarily to the moistening liquid, since concentration-gradient effects draw moistening liquid out of the moistened medium. Various aspects are useful for conventional inkjet printing. Various aspects heat the opposite side of the moistened medium from a printed image, further reducing the probability of image degradation while maintaining effective drying.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIGS. 11-17 are elevational cross-sections of media drying systems for removing a moistening liquid from a moistened medium according to various aspects.

Figure 1:
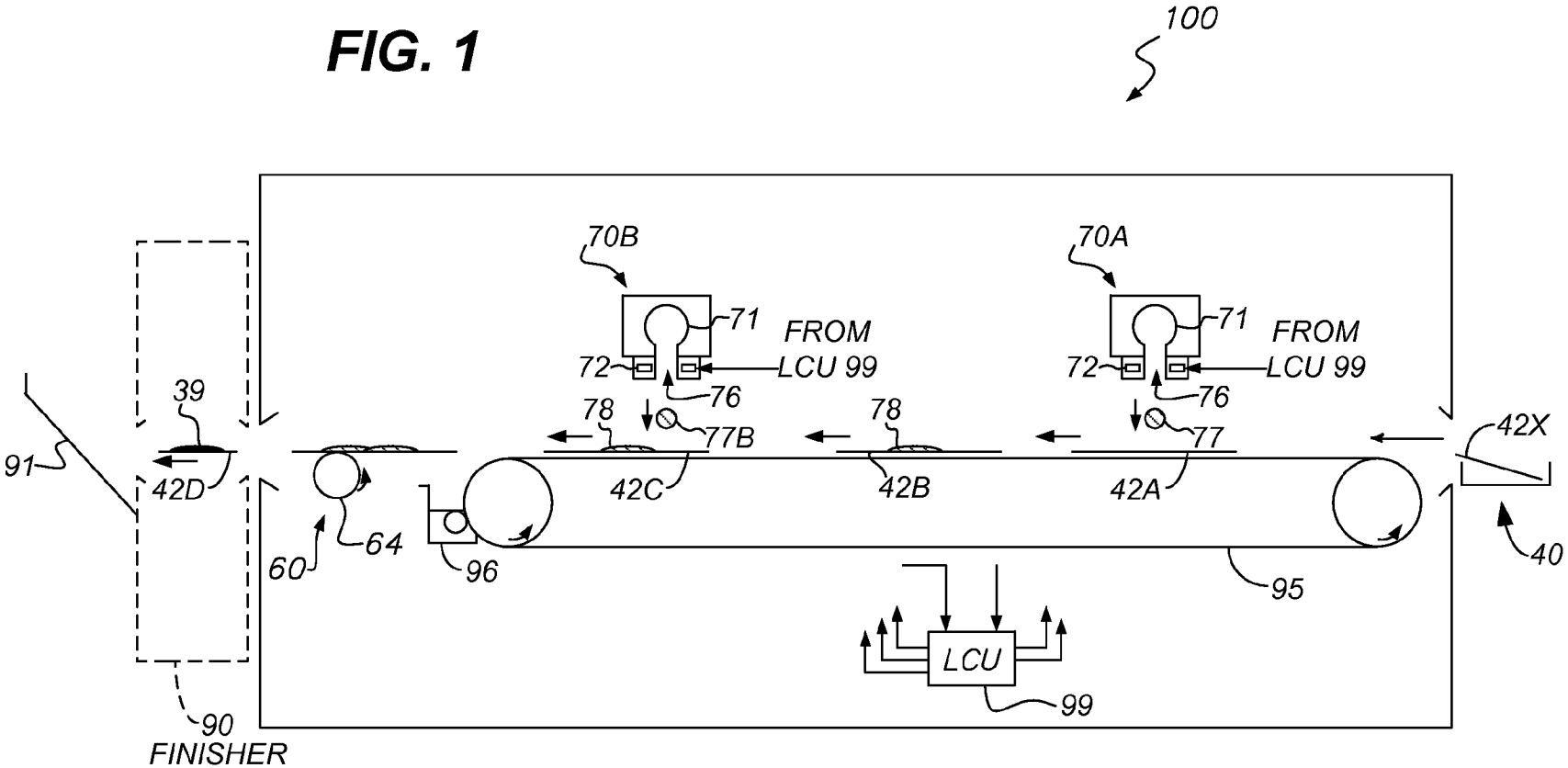
FIG. 1 is an elevational cross-section of a reproduction apparatus.

The attached drawings are for purposes of illustration and are not necessarily to scale.

DETAILED DESCRIPTION OF THE INVENTION

U.S. Pat. No. 8,251,505 to Hara, entitled "Recording apparatus and method of adjusting temperature of transport belt of recording apparatus," describes a transport belt that carries a target (e.g., a receiver). The belt is heated to accelerate drying liquid off the target. However, air gaps or bubbles can be present between the receiver and the transport belt. These can be microscopic air bubbles due to the roughness of the receiver or the belt. These bubbles act as insulators, reducing the rate of thermal transfer from the belt to the receiver. Therefore, there is still a need for improved ways of removing moisture from receivers.

Inkjet printing processes can be embodied in devices including printers, copiers, scanners, and facsimiles, and analog or digital devices, all of which are referred to herein as "printers." A digital reproduction printing system ("printer") typically includes a digital front-end processor (DFE), a print engine (also referred to in the art as a "marking engine") for applying ink to the recording medium, and one or more post-printing finishing system(s) (e.g., a UV coating system, a glosser system, or a laminator system). A printer can reproduce pleasing black-and-white or color visible images onto a recording medium. A printer can also produce selected patterns of ink on a recording medium, which patterns (e.g., surface textures) do not correspond directly to a visible image. The DFE receives input electronic files (such as Postscript command files) composed of images from other input devices (e.g., a scanner, or a digital camera). The DFE can include various function processors, such as a raster image processor (RIP), an image positioning processor, an image manipulation processor, a color processor, or an image storage processor. The DFE rasterizes input electronic files into image bitmaps for the print engine to print. In some aspects, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the recording medium. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g., digital camera images or film images).

As used herein, the term "paper" refers to a material that is generally made by pressing together moist fibers or weaving fibers. Papers include fibers derived from cellulose pulp derived from wood, rags, or grasses and drying them into flexible sheets or rolls. Paper generally contains moisture which remains after drying or is absorbed from exposure to air. Therefore, the term "paper" used herein includes conventional materials sold as paper and other materials, such as canvas, that possess corresponding characteristics.

As used herein, oliophilic and hydrophobic liquids are defined as organic liquids that are either immiscible, or only slightly miscible, with water. These include aliphatic and aromatic hydrocarbons. Hydrophilic and oliophobic liquids are defined as liquids that are wholly or substantially miscible with water. These include water-based solutions and suspensions such as inkjet inks containing pigments or dyes, water-based solutions, and low carbon alcohols (i.e., alcohols containing four or fewer carbons). Such alcohols include methanol, ethanol, propanol, butanol, isopropanol, isobutanol, and ethylene glycol. It should be noted that not all components of a hydrophilic liquid are necessarily soluble in water. For example, certain inkjet inks contain less than 10% (and generally less than 5%) pigment particles that are not soluble in water. Even though the pigment particles are not soluble in water, the inkjet ink is a hydrophilic liquid.

Inkjet inks contain a solvent or dispersant that either dissolves or disperses colorant. As used herein, "solvent" refers to this solvent or dispersant. Colorant can be in particulate form such as pigment particles. Alternatively, the colorant can be a dye that is either dissolved or dispersed in the solvent Inkjet inks can also contain other components such as surfactants, dispersants that impart electrical charge to pigment particles to create a stable suspension, humectants, and fungicides. Inkjet inks generally use hydrophilic solvents such as water or a low-carbon-containing alcohol.

In the following description, some aspects of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, methods described herein. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of aspects herein is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods described herein.

FIG. 1 is an elevational cross-section showing portions of a printer 100 (i.e., a "reproduction apparatus"). Printer 100 produces print images having one or more color components (e.g., four or six components). Various components of printer 100 are shown as rollers; other configurations are also possible, including belts. Receiver 42X is transported from supply unit 40, which can include active feeding subsystems as known in the art, into printer 100.

Printer 100 has one or more tandemly-arranged marking engines 70A, 70B. Each marking engine 70A, 70B produces a print image for a single color component.

In some aspects, marking engines 70A, 70B are inkjet marking engines. Inkjet marking engines 70A, 70B can each include a drop-on-demand printhead, either thermal or piezoelectric, or a continuous printhead, using gas, electrostatic, or other deflection methods. The example shown in FIG. 1 is a thermal drop-on-demand marking engine.

Each inkjet marking engine 70A, 70B includes one or more ink manifolds 71 that contain liquid ink, either under pressure or not. Heaters 72 are resistive ring heaters around nozzles 76 that heat ink in the ink manifold 71 to its boiling point. The expansion in volume as the liquid boils into gas drives an ink drop out of nozzle 76 towards a receiver. In the example shown, ink drop 77 is being driven by inkjet marking engine 70A towards receiver 42A.

Receiver 42B is shown between inkjet marking engines 70A and 70B. The ink drop 77 has spread out on receiver 42B to form ink image 78. Receiver 42C is shown in operative arrangement with inkjet marking engine 70B, which is jetting ink drop 77B towards the receiver 42C. Receivers 42X, 42A, 42B, 42C, 42D (also referred to as "imaging substrates" or "recording media") can be pieces or sheets of paper or other planar media, glass, fabric, metal, or other objects. Examples of such media include fabrics, uncoated papers such as bond papers, semi-absorbent papers such as clay coated papers commonly used in lithographic printing (e.g., Potlatch Vintage Gloss, Potlatch Vintage Velvet, Warren Offset Enamel, and Kromekote papers), and non-absorbent papers such as polymer-coated papers used for photographic printing.

Further details of inkjet marking engines are found in commonly-assigned U.S. patent application Ser. No. 13/245,931, U.S. Pat. No. 6,588,888, U.S. Pat. No. 4,636,808, and U.S. Pat. No. 6,851,796, each of which is incorporated herein by reference.

Piezoelectric drop-on-demand systems provide current to a piezoelectric actuator to cause it to deflect and push an ink drop out of ink manifold 71. Continuous-inkjet systems pressurize the ink in ink manifold 71 and break it into drops in a controlled manner (e.g., by selectively heating the ink stream in an appropriate timing sequence). In gas-deflection systems, two sizes of drops are produced, and an air flow not parallel with the direction of drop travel separates the two sizes of drops. Drops of one size strike the receiver; drops of the other size are caught and reused. Electrostatic-deflection systems charge drops to one of two charge states, and Lorentz forces between the drops and an electrode separate the two sizes of drops.

After ink image 78 is deposited on the receiver, carrier liquid in the ink is permitted to dry. Plural print images (e.g., separations of different colors) can be overlaid on one receiver before drying. In some printers, drying is accelerated by passing receiver 42D through dryer 60 in which receiver 42D is subjected to heat or vacuum to remove moisture from receiver 42D. Dryer 60 can include a heated drying roller 64 that heats receivers 42A, 42B, 42C, 42X to evaporate solvent in the ink (e.g., ink drops 77, 77B).

A media-transport system (e.g., transport web 95), transports the image-carrying receivers 42A, 42B, 42C to dryer 60, which dries the ink on the respective receivers 42A, 42B, 42C (e.g., by applying heat). Receivers 42A, 42B, 42C are serially de-tacked from transport web 95 to permit them to feed cleanly into dryer 60. Transport web 95 can then be reconditioned for reuse at cleaning station 96. Transport web 95 is optional if receiver 42X is a web rather than a cut sheet. In this case, web receiver 42X is maintained under tension while passing marking engines 70A, 70B and dryer 60.

The receivers 42D carrying the dried image (e.g., dried image 39) are transported from dryer 60 along a path either to output tray 91, or back to marking engines 70A, 70B to create an image on the backside of the receiver (e.g., receiver 42C), i.e. to form a duplex print. In various aspects, between dryer 60 and output tray 91, receiver 42D passes through finisher 90. Finisher 90 performs various media-handling operations, such as folding, stapling, saddle-stitching, collating, and binding.

Printer 100 includes logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), PAL, ASIC, microcontroller, or other digital control system. LCU 99 can include memory for storing control software and data.

Further details of continuous inkjet printers, including gas-flow deflection continuous-inkjet printers, are provided in commonly-assigned U.S. patent application Ser. No. 13/115,465, filed May 25, 2011, which is incorporated herein by reference. Further details of drop-on-demand inkjet printers are provided in commonly-assigned U.S. Pat. No. 7,350,902, which is incorporated herein by reference. Further details of continuous-inkjet printers and drop-on-demand inkjet printers are provided in U.S. patent application Ser. No. 13/547,152, filed Jul. 12, 2012, which is incorporated herein by reference.

Figure 2:
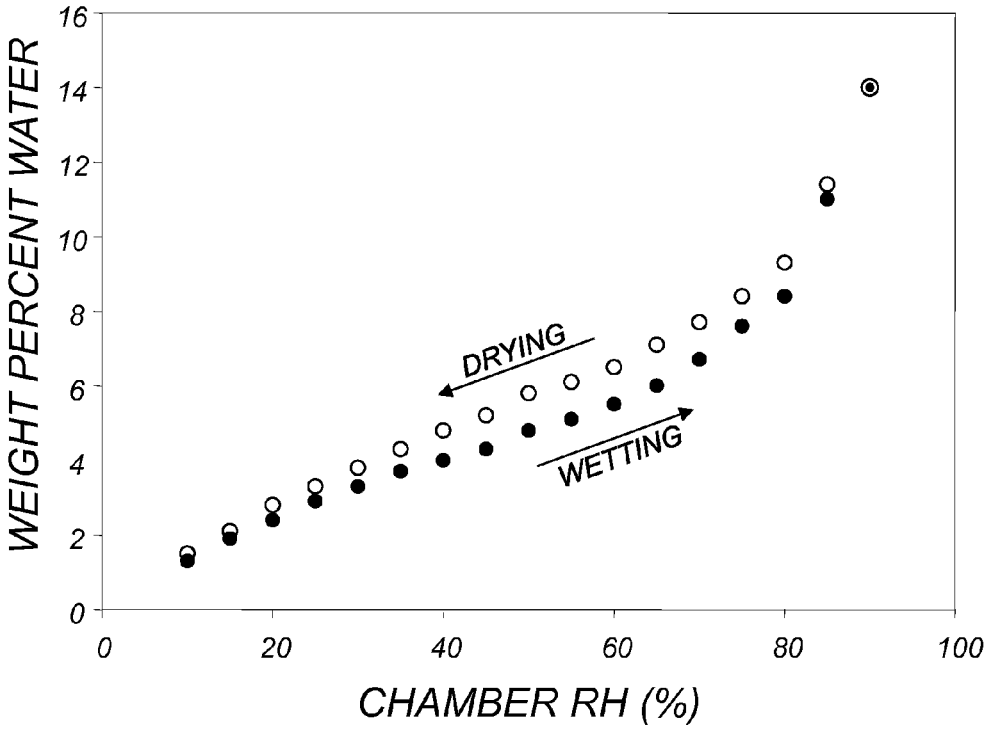
FIG. 2 shows the moisture content of a representative paper equilibrated to the relative humidity.

FIG. 2 shows the moisture content of a selected representative paper (measured in weight percent of water) as a function of atmospheric relative humidity (RH) (measured in percent). To take these measurements, the paper was placed in a chamber containing air at low RH. The moisture content of the chamber was increased in a series of steps. At each step, the paper was left in the chamber for enough time to permit it to equilibrate with the atmosphere in the chamber. The moisture content of the paper was then measured. The resulting data are shown in the solid circles (labeled as "wetting"). After reaching a high RH, the chamber RH was reduced stepwise. As before, at each step the paper was permitted to equilibrate, then was measured. The resulting data are shown in the open circles (labeled as "drying"). As shown, there is some hysteresis in the moisture content.

Figure 3:
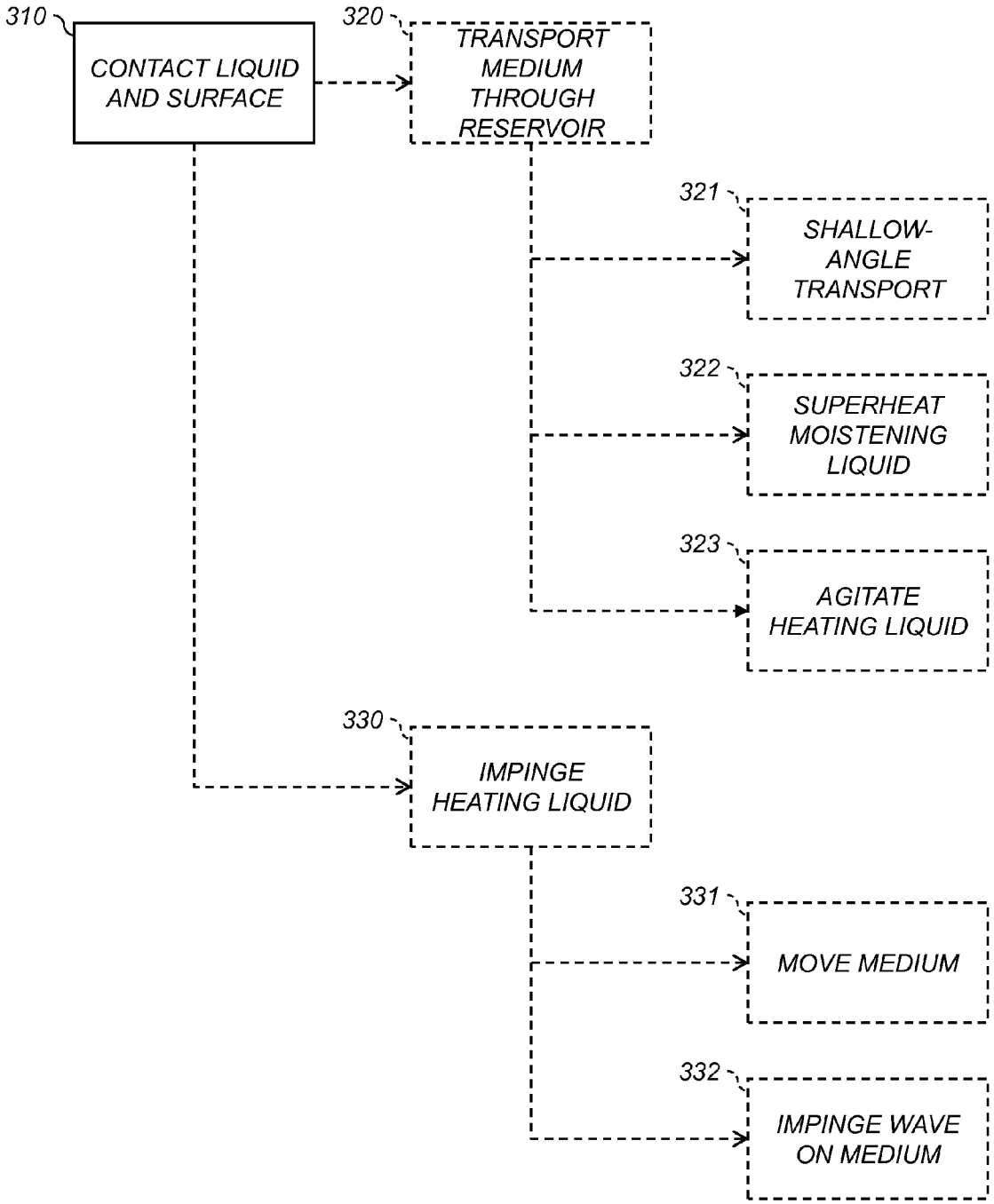
FIG. 3 is a flowchart of ways of removing a moistening liquid from a moistened medium according to various aspects.

FIG. 3 shows ways of removing a moistening liquid (e.g., ink or another marking liquid) from a moistened medium according to various aspects. The moistening liquid has a moistening-liquid boiling point. A "moistened medium" is a medium that has a hydrophilic moistening liquid on its surface or absorbed or otherwise held within itself (e.g., receiver 42C as described above with respect to FIG. 1,). In various aspects, the moistening liquid is water or an alcohol (e.g., an alcohol of at most four carbon atoms). In various aspects, the moistened medium includes a printed pattern formed using a liquid ink with a solute dissolved or suspended in an ink solvent. In this case, the moistening liquid is the ink solvent. In various of these aspects, after the moistening liquid has been removed from the moistened medium (contact liquid and surface step 310), the solute remains on the medium, thereby providing a printed image.

In various aspects, the moistening liquid is a precoating solution applied to the medium to improve its ink absorption, drying characteristics, or other properties. Precoating solutions can be applied and dried before ink is jetted onto the medium. Precoated media can also be dried and then stored for later use. Precoat curing can include a chemical reaction (e.g., when using latex-containing precoats) in addition to drying.

Processing begins with contact liquid and surface step 310. An arrow with a triangular arrowhead connects a step to a step that can follow it. An arrow with an open arrowhead connects a step to a substep that step can include.

In contact liquid and surface step 310, at least one surface of the moistened medium is brought into contact with a heating liquid (e.g., heating liquid is applied to the surface). Throughout this disclosure, the term "contact," when used in reference to the moistened medium or a surface thereof being brought into contact with a substance or component, includes contact between that substance or component and moistening liquid on the moistened medium or surface. In this example, the term "contact" means that heating liquid can contact the moistened medium or moistening liquid thereon.

The heating liquid is warmed to a temperature greater than the moistening-liquid boiling point. As a result, while the heating liquid and the surface are in contact, heat is transferred from the warmed heating liquid to the moistening liquid, in various aspects raising the temperature of the moistening liquid to at least the moistening-liquid boiling point. This vaporizes the moistening liquid and removes it from the moistened medium.

In various aspects, the heating liquid is warmed to a temperature above room temperature and less than the moistening-liquid boiling point. This increases the vapor pressure of the moistening liquid and can increase its rate of evaporation. In various aspects, the heating liquid is brought into contact with the moistening liquid under reduced pressure so that the moistening-liquid boiling point is reduced below its value at 1 atm.

In various aspects, the heating liquid is immiscible with the moistening liquid. Examples of heating liquids largely or substantially immiscible with hydrophilic moistening liquids include organic oils such as mineral oil or silicone oils, low-melting-point liquid metals such as mercury, Wood's metal, Rose's metal, or cerrosafe, and molten waxes. Some silicone oils can absorb small amounts of moisture in the liquid or gaseous phases. In various aspects, a viscoelastic modifier is added to an oil heating liquid, as discussed below. In other aspects, the heating liquid is a mineral oil. In other aspects, the heating liquid is a silicone oil (e.g., DOT 5 brake fluid). In other aspects, the heating liquid is a mineral oil. In other aspects, the heating liquid is or includes a glycol or glycol ether (e.g., triethylene glycol monobutyl ether, which is a component of DOT 3 brake fluid).

Hydrophilic moistening liquids can include water, low-molecular-weight alcohols or glycols such as those with four carbons or fewer, and liquid acids such as common low-molecular-weight organic acids (e.g., formic or acetic acid) and inorganic liquid acids (e.g., nitric or sulfuric acids). In various aspects, the heating liquid is substantially not absorbed by the moistened medium, either because of chemical composition or, as discussed below, because of moistening-liquid egress from the moistened medium. In various aspects, the temperature of the warmed heating liquid is less than a medium degradation temperature above which the medium irreversibly degrades.

When the warm heating liquid is applied to the at least one surface of the moistened medium, the liquid matches its shape approximately to that of the surface. This provides effective contact and improved heat transfer compared to systems with air gaps. Moisture in the item to be dried is boiled off by heat transferred from the warm heating liquid. This produces a concentration gradient of moisture from higher moisture content in the center of the moistened medium to lower moisture content at the surface in contact with the heating liquid. Moisture inside the moistened medium travels down this concentration gradient towards the surface. The result is a flow of moisture from inside to outside the moistened medium. This flow reduces the probability of burning the outside of the moistened medium, and helps keep the heating fluid out of the interior of the moistened medium. Moreover, the when the moistening liquid boils, the resulting vapor bubbles exert pressure on the heating liquid to further assist in keeping the heating liquid out of the interior of the moistened medium. This is similar to deep frying, which is a dry-heat process.

In various aspects, the moistened medium is removed from the heating liquid before the moisture level of the receiver drops below ~1 wt.pct. This reduces the probability of heating liquid flowing into the moistened medium as the flow of moisture out reduces. In various aspects, before the moistening liquid was applied, the moistened medium had approximately 5 wt.pct. water. The drying process provided by the contact liquid and surface step 310 can reduce the moistened medium back to approximately 5 wt.pct. water.

In various aspects, the warmed heating liquid undergoes a phase change while heat is being transferred from the warmed heating liquid to the moistening liquid. The phase change releases heat so that at least a portion of the released heat contributes to vaporizing the moistening liquid. That is, the warmed heating liquid transfers heat to the relatively cooler moistening liquid in the moistened medium. In various aspects, the phase change is a liquid-to-solid phase change, or another exothermic phase change that releases heat. A liquid-to-solid phase change can transfer the latent heat of fusion into the moistening liquid without a significant temperature change. This can advantageously reduce the temperature delta between the moistening liquid and the heating liquid.

In a phase change, two phases of the same system with the same Gibbs free energy at the same conditions can change phase with a change in a given factor (e.g., temperature). In a first-order phase transition, the Gibbs free energy is constant but with discontinuous first derivative across the change. As energy is added to the system, its temperature does not increase since it takes a certain amount of energy to transition from one curve to the other curve according to the well-known Clausius-Clapeyron equation. In a second-order phase transition, the Gibbs free energy and its derivative are constant, but its second derivative is discontinuous. Adding energy at such a transition continues to raise the temperature of the system, but at a different rate. That is, the relationship between specific heat and temperature is not linear. No latent heat is present in these transitions. Other phase transitions can also be used.

In optional transport medium through reservoir step 320, which is part of contact liquid and surface step 310, the surface of the moistened medium is brought into contact with the heating liquid by transporting the moistened medium along a transport path through a liquid reservoir containing the heating liquid. The moistened medium is thus submerged in the warmed heating liquid, which brings top and bottom surfaces of the moistened medium into contact with the heating liquid. The terms "top" and "bottom" do not restrict the orientation of the moistened medium, except as expressly described herein. The heating liquid can be in an open or closed container. The heating liquid can have a top surface at which it contacts air or another gas above it in the liquid reservoir. Optional transport medium through reservoir step 320 is followed by optional agitate heating liquid step 323 and can include optional shallow-angle transport step 321 or optional superheat moistening liquid step 322.

In optional shallow-angle transport step 321, which is part of optional transport medium through reservoir step 320, the transport path transports the moistened medium into the liquid reservoir at an angle of less than 15 degrees relative to the horizontal. This reduces the lateral force exerted on moistening liquid on the surface of the moistened medium as the moistened medium crosses through the top surface of the heating liquid in the reservoir. In various aspects, a pattern of moistening liquid is disposed on a first side of the moistened medium. The media-transport system transports the moistened medium into the liquid reservoir with the first side oriented downward. In this way, the top surface of the heating liquid in the reservoir presses the moistening liquid into the moistened medium as the medium enters the heating liquid in the reservoir. In aspects in which the moistening liquid is a marking liquid (e.g., ink), this can reduce smearing of the image as the top surface of the heating liquid passes over the moving moistened receiver.

In optional superheat moistening liquid step 322, which is part of optional transport medium through reservoir step 320, the heating liquid in the liquid reservoir has higher temperature and pressure in a lower zone than in an upper zone above the lower zone. The transport path is configured so that the moistened medium passes through the lower zone, and the heating liquid in the lower zone is heated to a temperature above a boiling point of the heating liquid at an ambient pressure. The moistened medium is transported out of the liquid reservoir into an environment at the ambient pressure. For example, if the moistening liquid boils at 100° C. at 1 atm and at 110° C. at the pressure in the lower zone, the heating liquid in the lower zone can be maintained at 108° C. As the moistened medium moves through the lower zone, the moistening liquid on the medium is heated to 108° C. After leaving the lower zone, the medium moves through cooler heating liquid (e.g., a gradient from 108° C. down to 99° C. at the top surface) and the moistening liquid cools down. The moistened medium is moved at a speed sufficiently fast that the moistening liquid does not cool below 100° C. before it reaches the top surface. Upon reaching the top surface, or a shallow enough region in the heating liquid to permit the moistening liquid to boil at its then-current temperature, the moistening liquid boils and is removed from the medium. The vaporized moistening liquid does not mechanically disturb the heating liquid as it would if it boiled deeper in the heating liquid, and the approximate location at which boiling will occur is controlled. This permits readily recapturing the vaporized moisturizing liquid if desired.

In optional agitate heating liquid step 323, pressure is applied to at least some of the heating liquid in the liquid reservoir using a mechanical transducer (e.g., an ultrasonic transducer) while the moistened medium is in the liquid reservoir. The applied pressure transports a first volume of liquid away from the moistened medium. A second volume of liquid having a temperature higher than a temperature of the first volume of liquid is moved into proximity with the moistened medium. The pressure wave in the heating liquid can have a component normal to the receiver or a component transverse to the receiver, or both.

In optional impinge heating liquid step 330, which is part of contact liquid and surface step 310, the surface of the moistened medium is brought into contact with the heating liquid by using a liquid-delivery system to impinge the warmed heating liquid onto at least one surface of the moistened medium. In various aspects, the liquid-delivery system is a spraying system for spraying the warmed heating liquid onto at least one surface of the moistened medium. In various aspects, the liquid-delivery system is a curtain-coating system that includes a slit through which the warmed heating liquid flows, thereby forming a liquid curtain which impinges onto a top surface of the moistened medium. The term "top surface" is used for convenience and does not constrain the orientation of the moistened medium or the liquid curtain. For example, the moistened medium can be moving almost vertically downward, and the curtain can be falling down on a path converging with the path of the moving receiver.

In optional move medium step 331, which is part of optional impinge heating liquid step 330, the liquid curtain moves at a liquid-curtain speed in a liquid-curtain direction. In this step, the moistened medium is moved so that the liquid curtain impinges on the moving moistened medium in a coating region and the speed component in the liquid-curtain direction of the moving moistened medium is less than (i.e., has a lesser magnitude than) the liquid-curtain speed at a selected point in the coating region where the liquid curtain contacts the surface of the moistened medium. This difference in speed (i.e., the magnitude of the velocity difference, denoted ΔV, where positive ΔV values indicate that the heating fluid is moving faster than the moistened medium) can introduce turbulent flow, which improves heat transfer.

Compared to a smaller ΔV, a larger ΔV can provide improved heat transfer but at a risk of greater image degradation by moving the moistening liquid (marking liquid). Furthermore, as ΔV increases, the heating fluid tends to pile up on the moistened medium because of the drag on the heating fluid from the medium. A larger ΔV thus provides more pressure to counteract the vapor pressure of evaporated moistening liquid, as is discussed below with respect to FIG. 18. A larger ΔV also corresponds to a thicker pile of heating fluid, which means more heat is available to transfer to the moistening liquid. The value of ΔV can be selected empirically to balance these factors. The ΔV that can be used without causing unacceptable image degradation is limited by the viscoelasticity of marking liquid. A more viscoelastic material can tolerate more ΔV without being disrupted. The ΔV budget also depends on the thickness of the marking liquid on the medium, and the coverage of marking liquid over the medium.

In optional impinge wave on medium step 332, which is part of optional impinge heating liquid step 330, the liquid-delivery system includes a liquid tank supplied with warmed heating liquid. A wave-forming system forms a stationary wave on a top surface of the warmed heating liquid in the liquid tank. The stationary wave can be a standing wave or a continuous laminar-flow fountain or curtain. The stationary wave can also be a low-pressure flow of heating liquid spilling out of a reservoir with a controlled spillway. A media-transport system transports the moistened medium over the top of the warmed heating liquid so that peaks of the stationary wave impinge on a bottom surface of the moistened media. The term "bottom" does not constrain the orientation of the medium.

In various aspects, the heating liquid is a straight-chain hydrocarbon. After applying heating liquid to the moistened medium, a thin layer of heating liquid can adhere to the moistened medium. The temperature of the heating liquid can be selected so that if this occurs the vapor pressure of the heating liquid in that layer is high enough that the heating liquid in the layer readily evaporates off the moistened medium.

Figure 4:
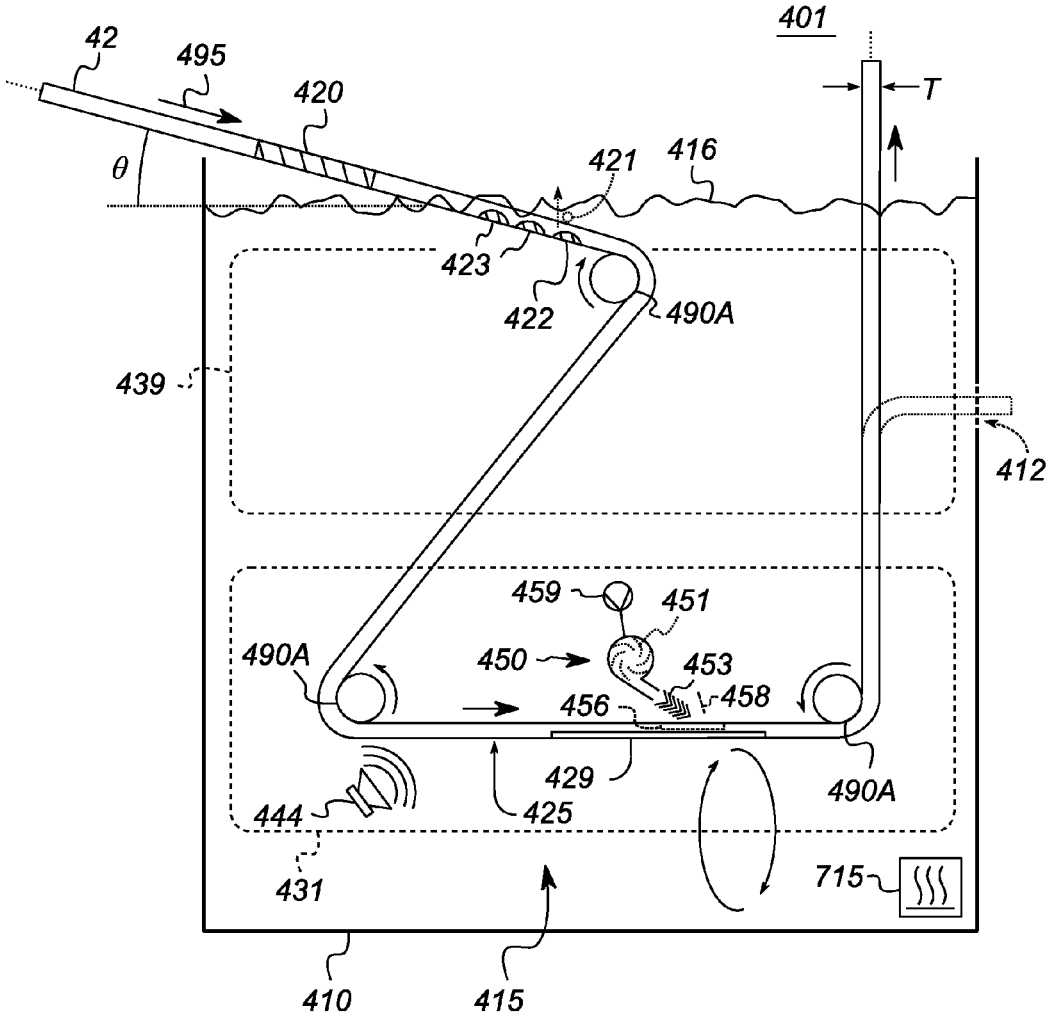
FIGS. 4-7 show media drying systems for removing a moistening liquid from a moistened medium according to various aspects.

FIG. 4 shows an exemplary media drying system for removing moistening liquid 420 from moistened medium 42 according to various aspects. The moistening liquid 420 has a moistening-liquid boiling point. Liquid reservoir 410 contains heating liquid 415 with top surface 416, represented graphically by a wavy line. Liquid-heating system 715 (represented graphically) warms heating liquid 415 in liquid reservoir 410 to a temperature greater than the moistening-liquid boiling point. Additional details of the liquid-heating system 715 are described below. A media-transport system transports the moistened medium 42 along transport path 495, which passes through liquid reservoir 410. Therefore, as the moistened medium 42 is transported along the transport path 495 it is submerged in the warmed heating liquid 415. Heat is thus transferred from the warmed heating liquid 415 to the moistening liquid 420, thereby vaporizing the moistening liquid 420 and removing it from the moistened medium 42. In various aspects, moistened medium 42 is a porous or semi-porous medium, and moistening liquid 420 is an ink containing a colorant (e.g., a dye or a pigment). In the example shown, the moistened medium 42 is a web and the media-transport system includes three rotatable members 490A (e.g., belts or rollers) around which moistened medium 42 is entrained.

In various aspects, heating liquid 415 is immiscible with moistening liquid 420. For example, moistening liquid 420 can be aqueous and heating liquid 415 can be an organic or silicone oil. In various aspects, heating liquid 415 is substantially not absorbed by moistened medium 42. For example, warm tar can be used as a heating liquid, and the receiver can be a semi-porous paper. The high molecular weight, and thus large size, of the molecules in the tar substantially restricts the extent to which those molecules can permeate the receiver. In an example, the tar is fluorinated to reduce its surface energy, further reducing spreading of the tar at the interface between the tar and the receiver, and thus reducing forces of adhesion between the tar and the receiver.

In another example, a cross-linked liquid can be used, for example, motor oil with an STP oil treatment (a mixture of mineral oil, petroleum distillates, and zinc) or MARVEL MYSTERY OIL (a mixture of naphthenic hydrocarbons, mineral spirits, and chlorinated hydrocarbons) added. The cross-linked liquid has large enough molecular weight that it does not readily penetrate the moistened medium. In another example, mercury can be used with a porous or semi-porous paper receiver. Mercury will generally not wet such papers.

In various aspects, a small amount of a miscible viscoelastic liquid modifier is added to heating liquid 415. For example, adding a shear-thickening fluid similar in behavior to SILLY PUTTY silicone (which can include dimethyl siloxane, glycerin, boric acid, $TiO_2$, crystalline silica, or THIXOTROL ST, CAS 51796-19-1) to heating liquid 415 can reduce the flow of heating liquid 415 into moistened medium 42 when moistened medium 42 is moving quickly and producing significant shear forces or rates between the moistened medium 42 and the heating liquid 415. However, heating liquid 415 is still permitted to flow under lower shear, so it can be heated, pumped, and spread across the moistened medium 42.

In various aspects, the temperature of warmed heating liquid 415 is less than a medium degradation temperature above which the medium 42 irreversibly degrades. In an example, moistened medium 42 is paper and heating liquid 415 is at a temperature less than the autoignition temperature of the paper (e.g., 451° F.). In another example, moistened medium 42 includes a thermoplastic polymer, and the temperature of heating liquid 415 is less than a temperature at which the polymer will soften to the point that it undergoes plastic deformation while being transported by the media-transport system.

In various aspects, the moistening liquid 420 is water or an alcohol. Pigment can be carried in separate particles in moistening liquid 420. Heating liquid 415 can be an aliphatic hydrocarbon, or low-molecular-weight polydimethylsiloxane (PDMS). Heating liquid 415 can also be an ISOPAR (e.g., ISOPAR-M or ISOPAR-K). For polymeric heating liquids 415, the molecular weight can be selected to provide a boiling point in a desired range. Higher molecular weight can correlate with a higher boiling point. In various examples, heating liquid 415 is selected to have a vapor pressure low enough that heating liquid 415 is substantially liquid, and not gaseous, at a desired heating temperature above the boiling point of moistening liquid 420. In various aspects, oxygen concentration in heating liquid 415 is kept low to reduce the probability that moistening liquid 420 will ignite at the heating temperature.

In various aspects, the media-transport system transports moistened medium 42 into liquid reservoir 410 at an angle θ of less than 15° relative to the horizontal. This reduces the effect on moistening liquid 420 of bubbles of vaporized moistening liquid 420 traveling up through heating liquid 415. For example, moistening liquid 420 can be ink jetted by an inkjet printer. Angle θ can be selected so that bubbles 421 of vaporized moistening liquid 420 do not significantly disturb adjacent drops.

In an example, the moistened medium 42 is 20 lb. bond paper, which has a thickness T of approximately 0.0038" (96.5 μm). Ink drops deposited at 600 dpi (0.0236 dpμm) are 42.3 μm on a side. Assuming that bubble 421 emerges from the center of a deposited drop 422, it is desirable that the bubble 421 be laterally confined within the drop 422 to reduce disruption of adjacent drops 423. The maximum lateral offset of bubble 421 should therefore be half a drop, or 21.2 μm (from the center to edge of drop 422), over a travel through moistened medium 42 of 96.5 μm (through the medium from bottom to top along the path a bubble can travel, neglecting the increase in travel distance due to the tilt of the paper since that tilt is small). The resulting angle is 0.216 rad≈12.4° off the normal to the sheet. Therefore, if the sheet is tilted less than 12.4° away from the horizontal, a drop from the backside center of drop 422 travelling up will not disrupt an adjacent drop 423. In another example, moistened medium 42 has a thickness of 79.0 μm and, at 600 dpi, an angle of 15° is used.

In various aspects, moistened medium 42 includes a pattern 429 of moistening liquid 420 on first side 425 of moistened medium 42. In the example shown, drops 422, 423 can also be part of pattern 429.

In various examples, pattern 429 can be a printed pattern formed using a liquid ink. The liquid ink can include a solute dissolved or suspended in an ink solvent, namely moistening liquid 420.

In various aspects, the media-transport system transports the moistened medium 42 through liquid reservoir 410 with first side 425 oriented downward. In this way, heating liquid 415 that transfers heat to moistening liquid 420 in pattern 429 surrenders heat. This relatively cooler heating liquid 415 above hotter heating liquid 415 can establish convective circulation, as shown by the elliptical arrows, that will replace the cooler heating liquid 415 near pattern 429 with fresh, hotter heating liquid 415 from lower in liquid reservoir 410. First side 425 can be the side most recently printed, therefore the side with the most excess moisture (from ink). Orienting first side 425 downward permits the fresh heating liquid 415 circulating from below to directly contact the freshly-printed ink, improving drying performance.

In examples described above using a pattern 429 of liquid ink, after moistening liquid 420 has been removed from moistened medium 42, the solute remains on the medium 42. The solute can be colorant forming an image.

In various aspects (not shown), moistened medium 42 is transported in upper zone 439 and not in lower zone 431. This permits taking advantage of the heat rising through liquid reservoir 410, keeping the temperature of upper zone 439 high. In other aspects, the top and right rotatable members 490A are used and the left is not. Moistened medium 42 descends quickly into lower zone 431, then returns quickly through upper zone 439 (shown at the right-hand side of liquid reservoir 410). During the return, the temperature of heating liquid 415 rises approaching top surface 416. This permits heat to continue to be transferred into moistening liquid 420, even as moistened medium 42 heats up in heating liquid 415.

In various aspects, the heating liquid 415 in liquid reservoir 410 includes lower zone 431 and upper zone 439 above lower zone 431. Heating liquid 415 has higher temperature and pressure in lower zone 431 than in upper zone 439. The media-transport system is configured so that moistened medium 42 passes through lower zone 431, in which heating liquid 415 is heated to a temperature above a boiling point of the heating liquid at an ambient pressure. The media-transport system transports moistened medium 42 out of liquid reservoir 410 into environment 401 at the ambient pressure. In various examples, if some heating liquid 415 has wetted the moistened medium 42 under high pressure in lower zone 431, when the moistened medium 42 emerges into the relatively lower-pressure environment 401, it is above its boiling point at that pressure. As a result, it evaporates off cleanly. Vapor catchers can be used to capture the evaporated heating liquid 415.

Moreover, the high pressure in lower zone 431 exerts greater force on vapor bubbles that escape moistened medium 42 in lower zone 431 than on those in upper zone 439. These bubbles can exhibit the Leidenfrost effect under appropriate temperature conditions, whereby the bubbles remain close to moistened medium 42, insulating it from heating liquid 415. The high pressure can compress the Leidenfrost layer, improving heat transfer from heating liquid 415 to moistened medium 42. This is discussed below with reference to FIG. 18. The high pressure advantageously improves heat transfer and reduces the danger of paper blistering (since there is no solid barrier to the flow of evaporated moistening liquid 420).

In various aspects, a mechanical transducer 444 applies pressure to at least some of the heating liquid 415 in liquid reservoir 410 while the moistened medium 42 is in the liquid reservoir 410. The transducer 444 is represented graphically by a loudspeaker symbol, since transducer 444 can include a moving membrane. Transducer 444 can also include an impeller or piezoelectric actuator. The waves of pressure produced in heating liquid 415 by transducer 444 are represented graphically as arcs. When a pressure wave nears the moistened medium 42, a first volume of liquid is transported away from the moistened medium 42 by the applied pressure and a second volume of liquid having a temperature higher than a temperature of the first volume of liquid is moved into proximity with moistened medium 42. That is, agitation of heating liquid 415 by transducer 444 moves heating liquid 415 that has already transferred heat to moistened medium 42 away from moistened medium 42 so that fresh, hot heating liquid 415 can transfer heat into moistened medium 42.

In various aspects, a pressurizer 450 in the liquid reservoir 410 produces a jet 453 of heating liquid 415. Jet 453 (represented graphically as a series of arrowheads) impinges on moistened medium 42 in pressure zone 456. Moistening liquid 420 in the pressure zone 456 is heated above the moistening-liquid boiling point and remains liquid due to the higher pressure. When the motion of the moistened medium 42 carries such heated moistening liquid out of the pressure zone 456, such moistening liquid vaporizes. This permits controlling where vapor is formed in liquid reservoir 410.

Pressurizer 450 can include an impeller 451 and nozzle, as shown, or an airfoil, baffle (e.g., at 90° to the transport direction of moistened medium 42), or other deflector arranged to direct heating liquid 415 towards moving moistened medium 42. The term "jet" does not require an active element. In an example, the moving moistened medium 42 drags heating liquid 415 with it, and pressurizer 450 is a fixed vane angled closer to the moving moistened medium 42 in the downstream direction. This vane compresses the moving heating liquid 415 close to the moving moistened medium 42. In various aspects, fixed vanes are used to agitate the heating liquid 415 moving with moistened medium 42. In various aspects, pressurizer 450 includes a plenum (represented graphically as the circle around the impeller blades) having an outlet (represented as the tube extending from the impeller housing) directed towards pressure zone 456, and pump 459 to supply heating liquid 415 under pressure through the plenum. In various aspects, pressurizer 450 includes impeller 451 and directing member 458 fixed in position in liquid reservoir 410. Impeller 451 directs heating liquid 415 towards directing member 458, and directing member 458 directs the impelled heating liquid 415 in jet 453 towards pressure zone 456.

In various aspects, the media-transport path transports the moistened medium 42 into and out of liquid reservoir 410 through an interface surface (here, top surface 416; in general, where heating liquid 415 meets another fluid with which it is substantially immiscible, e.g., a gas) of heating liquid 415 in liquid reservoir 410. In other aspects, the media-transport path transports moistened medium 42 into or out of liquid reservoir 410 through a slit 412 in a surface of the liquid reservoir 410. This is represented graphically by the dotted-line path extending through the side of the liquid reservoir 410. Preferably, the slit 412 is no more than twice the thickness of the moistened medium 42. That slit 412 is so thin that it resists flow through slit 412, so that heating liquid 415 substantially does not drain out of liquid reservoir 410. Heating liquid 415 that does exit liquid reservoir 410 through slit 412 can be captured and returned to liquid reservoir 410 (e.g., using a pump).

In various aspects, warmed heating liquid 415 undergoes a phase change while heat is being transferred from warmed heating liquid 415 to moistening liquid 420. The phase change releases heat so that at least a portion of the released heat contributes to vaporizing moistening liquid 420. In various examples, the phase change is a liquid-to-solid phase change, or another exothermic phase change that releases heat. Phase changes are described above.

Figure 5:
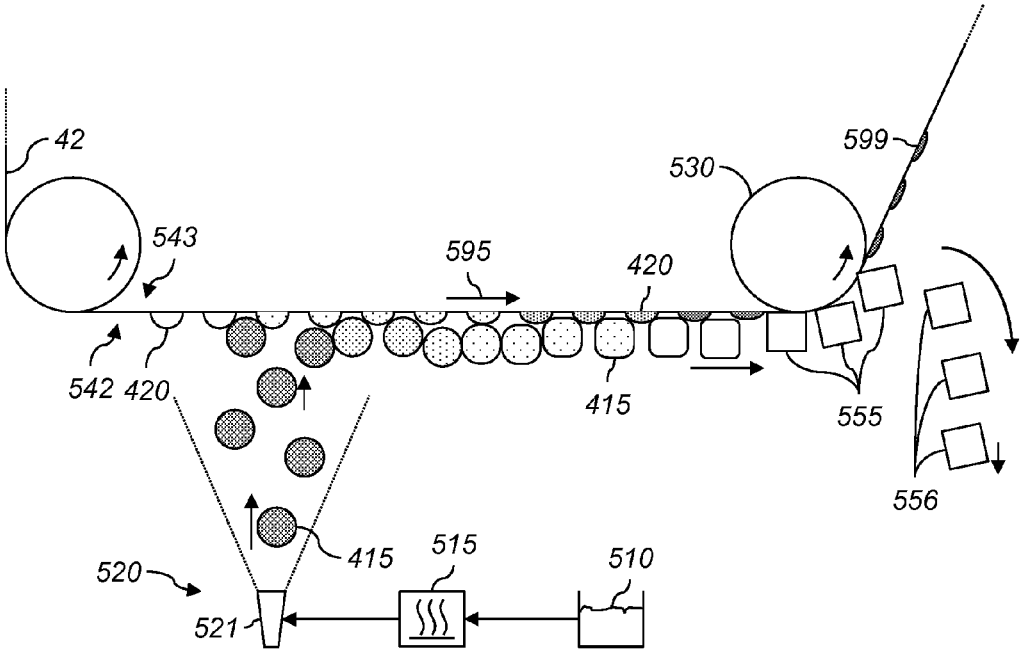

FIG. 5 is an elevation of an exemplary media drying system for removing moistening liquid 420 from moistened medium 42 according to various aspects. Moistening liquid 420, represented graphically by semi-ellipses on surface 542 of moistened medium 42, has a moistening-liquid boiling point. Moistened medium 42 can be cut sheets on a belt, or can be a web of material. (Here and throughout this disclosure, portions of belts or webs are sometimes omitted from the drawings for clarity.) The moistened medium 42 is transported along transport path 595 by appropriate media transport mechanisms, which can include belts, rollers and motors.

Liquid-supply system 510 provides heating liquid 415, represented graphically by circles and rounded rectangles. Liquid-supply system 510 can include a tank, a reservoir (represented graphically in this example), a pump (peristaltic, impeller, or otherwise), an Archimedes screw, or any other liquid-storage or -transfer device. Liquid-heating system 515 warms heating liquid 415 to a temperature greater than the moistening-liquid boiling point, and can include a resistive or inductive heater, a burner, a pipe carrying hot steam, a heat exchanger, or other heating devices. Throughout this disclosure, liquid-supply system 510 and liquid-heating system 515 can be components of a single unit that supplies heating liquid 415.

Liquid-delivery system 520 impinges warmed heating liquid 415 onto surface 542 of moistened medium 42. As a result, heat is transferred from heating liquid 415 to moistening liquid 420, thereby vaporizing moistening liquid 420 and removing it from moistened medium 42.

In various aspects, the liquid-delivery system 520 includes spraying system 521 (which can include, for example, an atomizer or a high-pressure pump) for spraying warmed heating liquid 415 onto surface 542 of moistened medium 42. For clarity, not all drops of moistening liquid 420 or of heating liquid 415 are labeled.

In the example shown, relative heat is represented graphically by the relative density of hatch marks on each drop of heating liquid 415. Initially, drops of heating liquid 415 are warmer than drops of moistening liquid 420. This is represented by dense hatching on heating liquid 415 and the absence of hatching on moistening liquid 420. As heat is transferred, moistening liquid 420 gains heat (is shaded darker) and heating liquid 415 loses heat (is shaded lighter or not at all). Evaporation of the drops of moistening liquid 420 is represented graphically by a decreasing thickness of the ellipses. In an example, drop 599 is entirely solute; all the solvent (moistening liquid 420) has evaporated off the moistened medium 42 by the time the moistened medium 42 reaches this point along the transport path 595.

In various aspects, moistened medium 42 includes a printed pattern (here, represented by the drops of moistening liquid 420) formed on a printed surface (surface 542) of moistened medium 42 using a liquid ink. The liquid ink includes a solute dissolved or suspended in moistening liquid 420, which is an ink solvent. After moistening liquid 420 has been removed from the moistened medium 42, the solute remains on moistened medium 42, e.g., as represented by drop 599.

In various aspects, moistened medium 42 includes a printed surface (here, surface 542) and a non-printed surface (surface 543). In the configuration shown in FIG. 5, the heating liquid 415 impinges onto the printed surface (surface 542) of moistened medium 42. In other configurations, the heating liquid 415 can impinge onto the non-printed surface (surface 543) of moistened medium 42. This has the advantage that the impinging heating liquid 415 is less apt to disturb the printed pattern, although the rate of heat transfer to the moistening liquid 420 will generally be somewhat lower.

As discussed above, in various aspects, heating liquid 415 is immiscible with moistening liquid 420. In various aspects, the heating liquid 415 is substantially not absorbed by moistened medium 42. In various aspects, the temperature of the warmed heating liquid 415 is less than a medium degradation temperature above which the medium 42 irreversibly degrades. In various aspects, moistening liquid 420 is water or an alcohol.

In various aspects, warmed heating liquid 415 undergoes a phase change while heat is being transferred from warmed heating liquid 415 to moistening liquid 420. The phase change releases heat such that at least a portion of the released heat contributes to vaporizing the moistening liquid 420. Phase changes are described above. In an example, the phase change is from liquid to solid. Liquid drops of heating liquid 415 are represented graphically as circles. Solidified drops of heating liquid 415 (solidified heating liquid 555) are represented graphically as rectangles. Drops of heating liquid 415 represented graphically as rounded rectangles are in the process of solidifying.

In various aspects, at least some of the heating liquid 415 is solid after the phase change, as shown by solidified heating liquid 555. Moistened medium 42 travels along transport path 595 arranged so that solidified heating liquid is dislodged from moistened medium 42 as it undergoes a change in surface orientation. Changes in surface orientation include changes in the direction of the normal vector or surface area of surface 542. Examples include traveling around a roller 530 (shown), twisting out of the plane of surface 542, or stretching in the plane of surface 542. All of these changes in surface orientation exert force that assists in breaking solidified heating liquid 555 off surface 542. In this example, solidified heating liquid 555 does not bend as medium 42 travels around roller 530. As a result, drops or particles of solidified heating liquid 555 detach from moistened medium 42, forming particles or flakes of detached solidified heating liquid 556. These can be vacuumed, blown, or electrostatically or magnetically forced away from medium 42, or can be permitted to fall under the influence of the Earth's gravity (as shown). In an example, moistened medium 42 is twisted through 90° from a horizontal orientation, while heating liquid 415 is applied to it, to a vertical orientation, which permits gravity to pull detached solidified heating liquid 556 off moistened medium 42, away from drop 599.

Figure 6:
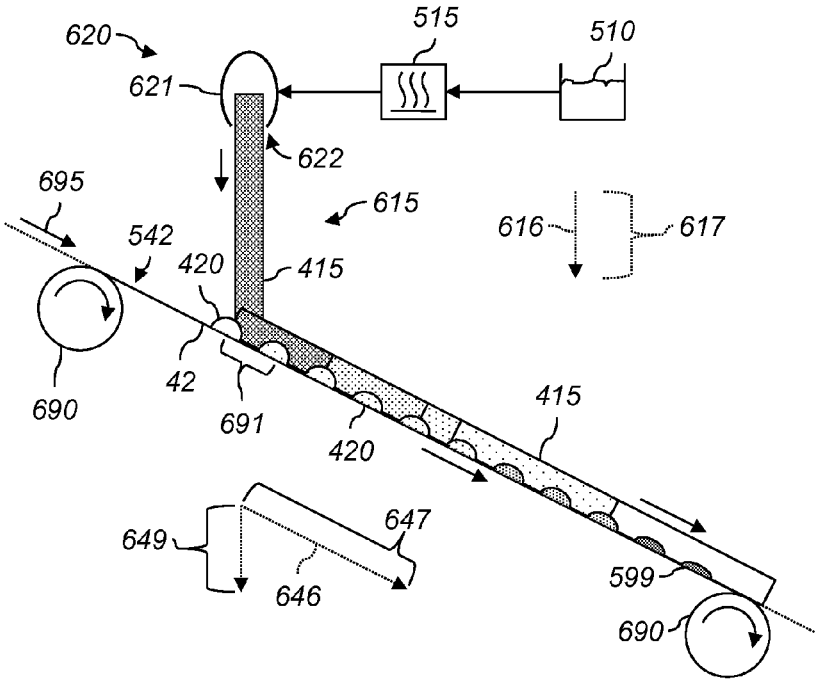

FIG. 6 is an elevation of an exemplary media drying system for removing moistening liquid 420 from moistened medium 42 according to various aspects. Moving moistened medium 42, moistening liquid 420, surface 542, liquid-supply system 510, heating liquid 415, and liquid-heating system 515 are as shown in FIG. 5. The moistened medium 42 travels along a transport path 695. A liquid-delivery system 620 includes curtain-coating system 621. Curtain-coating system 621 includes slit 622 through which warmed heating liquid 415 flows, thereby forming liquid curtain 615 that impinges on surface 542 of moistened medium 42. Liquid curtain 615 is represented graphically by various connected rectangles, hatched to represent heat as discussed above with reference to FIG. 5. Moistened medium 42 can be oriented in any way with respect to liquid curtain 615, provided heating liquid 415 impinges on surface 542.

In various aspects, when liquid curtain 615 contacts surface 542 of moistened medium 42, liquid curtain 615 has liquid-curtain speed 617 in liquid-curtain direction 616. For clarity, all speeds and directions are shown as dotted-line vectors, the length shown being proportional to the speed (arbitrary units).

A media-transport system (including rotatable transport members 690) transports moistened medium 42 so that liquid curtain 615 impinges on moistened medium 42 in coating region 691. (Liquid curtain 615 can also contact moistened medium 42 downstream of coating region 691.) In coating region 691, moistened medium 42 has medium-transport speed 647 in medium-transport direction 646. Curtain-coating system 621 and the media-transport system are arranged so that speed component 649 in liquid-curtain direction 616 of transported moistened medium 42 is within ±20% of liquid-curtain speed 617 at a point where liquid curtain 615 contacts surface 542 of moistened medium 42. This can reduce damage to the image in coating region 691, since the liquid curtain does not experience a significant change in vertical speed. Such a change would cause shear and turbulence in liquid curtain 615, possibly degrading a printed image by moving the moistening liquid 420.

In various aspects, warmed heating liquid 415 undergoes a phase change while heat is being transferred from warmed heating liquid 415 to moistening liquid 420, as described above. The phase change releases heat such that at least a portion of the released heat contributes to vaporizing moistening liquid 420. For cases where a liquid-to-solid phase change occurs, the solidified heating liquid 555 (FIG. 5) can be dislodged from the medium 42 using methods such as those discussed earlier with reference to FIG. 5.

Figure 7:
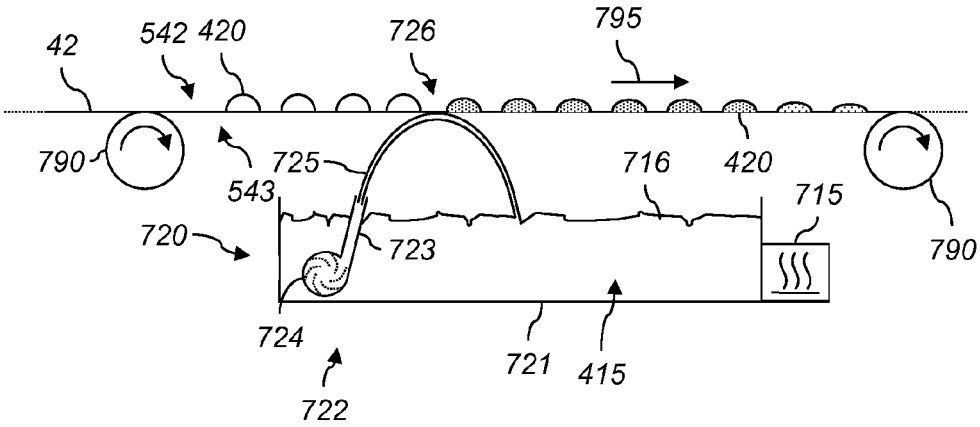

FIG. 7 is an elevation of an exemplary media drying system for removing moistening liquid 420 from moistened medium 42 according to various aspects. Moistened medium 42, moistening liquid 420, surfaces 542 and 543, and heating liquid 415 are as shown in FIG. 5. The moistened medium 42 travels along a transport path 795.

A liquid-delivery system 720 includes a liquid tank 721 (part of the liquid-supply system) supplied with warmed heating liquid 415. Liquid-heating system 715 keeps heating liquid 415 in liquid tank 721 warm. Wave-forming system 722, in this example nozzle 723 fed by pump 724, forms stationary wave 725 on top surface 716 of warmed heating liquid 415 in liquid tank 721. Other methods for forming a stationary wave 725 on the surface of a liquid are well-known in the wave-soldering art. Any such method can be used in accordance with the present invention.

A media-transport system, in this example including rotatable members 790 (e.g., belts or drums), transports moistened medium 42 along transport path 795 over the top of warmed heating liquid 415 so that one or more peak(s) of stationary wave 725 impinge on a lower surface (surface 543) of moistened medium 42. Heat is transferred through moistened medium 42 to the drops of moistening liquid 420. The hatching of drops of moistening liquid 420 represents those drops gaining heat when passing peak 726, and the height of the drops represents moistening liquid 420 evaporating away and the drops correspondingly cooling.

In various aspects, warmed heating liquid 415 undergoes a phase change while heat is being transferred from warmed heating liquid 415 in stationary wave 725 to moistening liquid 420. The phase change releases heat such that at least a portion of the released heat contributes to vaporizing moistening liquid 420, as described above. The phase change can be a liquid-to-solid phase change, or another exothermic phase change that releases heat. In various aspects, at least some of the heating liquid is solid after the phase change. Moistened medium 42 travels along a transport path arranged so that solidified heating liquid is dislodged from the moistened medium as it undergoes a change in surface orientation. This is discussed above with respect to FIG. 5.

In various aspects, a media drying system for removing a moistening liquid 420 from a moistened medium, the moistening liquid 420 having a moistening-liquid boiling point, includes a liquid reservoir containing heating liquid 415 (e.g., as shown in FIG. 4). A liquid-heating system 715 warms the heating liquid in the liquid reservoir 410 to a temperature greater than the moistening-liquid boiling point. In various aspects, a rotatable liquid-blocking member (e.g., a drum) has a liquid-blocking layer with an inner surface and an outer surface. The liquid-blocking layer at least partially encloses the liquid reservoir such that the heating liquid 415 contacts the inner surface of the liquid-blocking barrier. That is, the liquid-blocking layer encloses a volume of heating liquid 415. A media-transport system transports the moistened medium 42 along a transport path in which the moistened medium 42 contacts or is entrained around the liquid-blocking member so that the moistened medium 42 is brought into contact with the outer surface of the liquid-blocking layer. For example, the liquid-blocking member can be the outside of a hollow drum, and the interior of the drum can be the liquid reservoir. When the moistened medium 42 contacts the outside of the drum, heat is transferred through the liquid-blocking layer from the warmed heating liquid 415 to the moistening liquid 420, thereby vaporizing the moistening liquid 420 and removing it from the moistened medium 42. The liquid-blocking layer can be a thin membrane or a solid metal layer. This permits rapidly removing heat from the drum (e.g., in case of a receiver jam, by removing the heating liquid 415 therefrom).

The rotatable liquid-blocking member can be a drum that rotates around a central axis. The liquid-blocking layer can thus be a circumferential surface of the drum, and the liquid reservoir be contained within the drum. A mixer can be included inside the liquid reservoir, the mixer adapted to mix the heating liquid 415 in the liquid reservoir. For example, the mixer can be a powered impeller that circulates liquid in the reservoir, or a fixed vane inside a moving reservoir.

In various aspects, the rotatable liquid-blocking member is a belt that is transported around a belt path. The belt forms at least one surface of the liquid reservoir. In various aspects, a backing member (e.g., a pressure roller) presses the moistened medium 42 against the liquid-blocking layer. In various aspects, the liquid-blocking barrier is permeable to the vaporized moistening liquid 420. For example, the liquid-blocking barrier can be GORE-TEX or another material that is substantially permeable to vaporized moistening liquid 420 (e.g., water vapor) but not to heating liquid 415 (e.g., oil). Throughout this disclosure, moistened medium 42 (FIG. 4) can be transported by belts or drums permeable to vaporized moistening liquid 420.

In various aspects, the warmed heating liquid 415 undergoes a phase change while heat is being transferred from the warmed heating liquid 415 to the moistening liquid 420, as described above. The phase change releases heat such that at least a portion of the released heat contributes to vaporizing the moistening liquid 420. The phase change can be a liquid-to-solid phase change, or another exothermic phase change that releases heat.

In various aspects, the moistened medium 42 includes a printed pattern formed using a liquid ink, the liquid ink including a solute dissolved or suspended in an ink solvent, the moistening liquid 420 being the ink solvent. After the moistening liquid 420 has been removed from the moistened medium 42, the solute remains on the medium 42. The temperature of the warmed heating liquid 415 can be less than a medium degradation temperature above which the medium 42 irreversibly degrades. The moistening liquid 420 can be water or an alcohol. The moistening liquid 420, here and throughout this disclosure, can include a surfactant to lower the surface tension of the moistening liquid 420 to increase spreading of the moistening liquid 420 on the surface of the medium 42. For example, water, with a surface tension of 72 dynes/cm, does not spread significantly on some polymeric surfaces. Adding a surfactant, (e.g., a detergent) reduces the surface tension, thereby increasing the amount of spreading.

Figure 8:
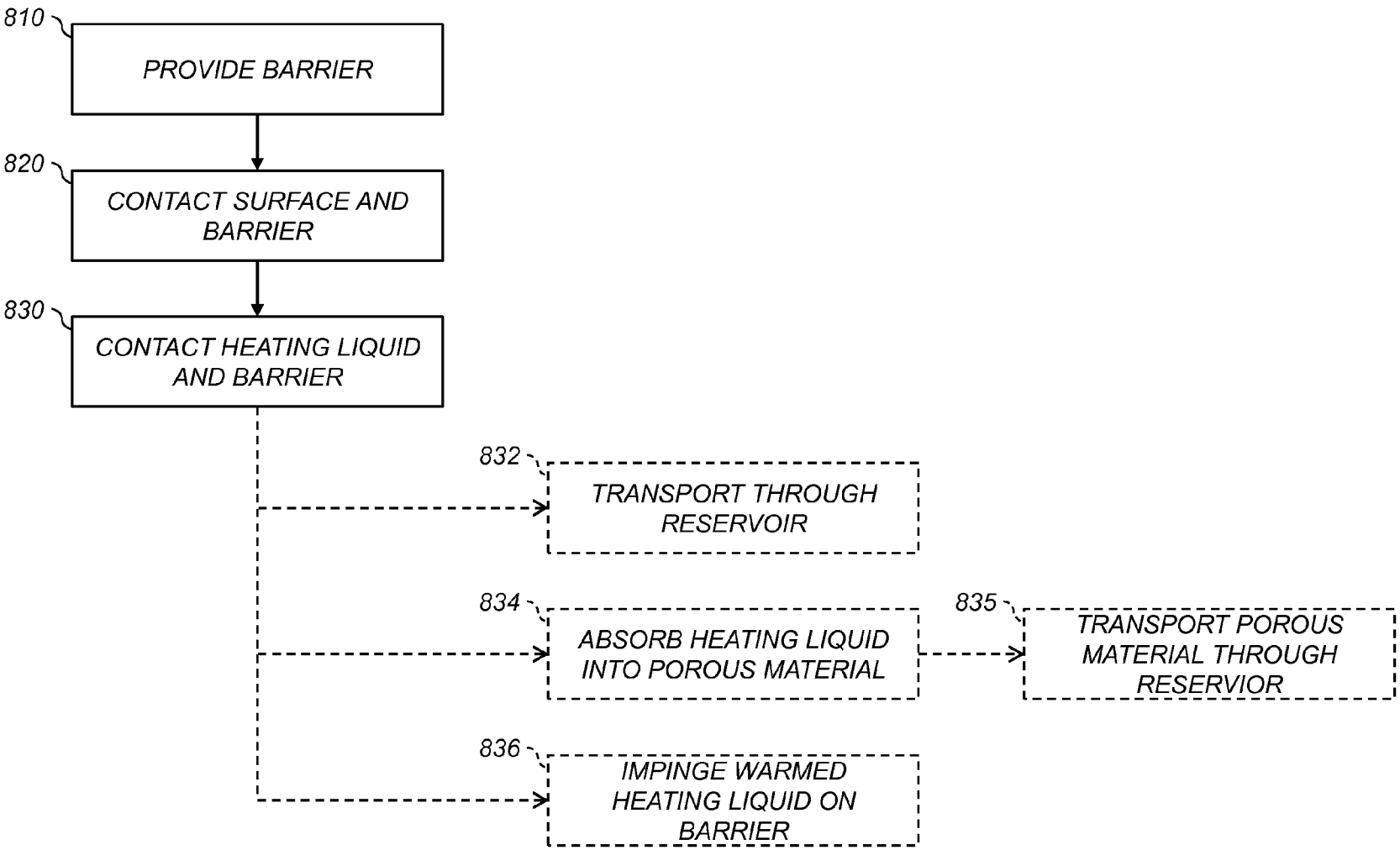
FIG. 8 is a flowchart of ways of removing a moistening liquid from a moistened medium according to various aspects.

FIG. 8 shows methods of removing a moistening liquid 420 (FIG. 4) from a moistened medium 42 (FIG. 4) according to various aspects. The moistening liquid 420 (FIG. 4) has a moistening-liquid boiling point. Processing begins with provide barrier step 810. An arrow with a triangular arrowhead connects a step to a step that can follow it. An arrow with an open arrowhead connects a step to a substep that step can include.

In provide barrier step 810, a liquid-blocking barrier is provided. The barrier has a first surface and a second surface that is impermeable to heating liquid 415 (FIG. 4). Provide barrier step 810 is followed by contact surface and barrier step 820.

In contact surface and barrier step 820, a surface of the moistened medium 42 is brought into contact with the first surface of the liquid-blocking barrier. In various aspects, the liquid-blocking barrier is permeable to the vaporized moistening liquid (e.g., GORE-TEX), as described above. In various aspects, the liquid-blocking barrier is a membrane belt which moves together with the moistened medium. Contact surface and barrier step 820 is followed by contact heating liquid and barrier step 830.

In contact heating liquid and barrier step 830, the heating liquid 415 is brought into contact with the second surface of the liquid-blocking barrier. The heating liquid 415 is at a temperature greater than the moistening-liquid boiling point, so heat is transferred through the liquid-blocking barrier from the heating liquid 415 to the moistening liquid 420. This vaporizes the moistening liquid 420 and removes it from the moistened medium 42.

In various aspects, the moistened medium 42 includes a printed pattern formed using a liquid ink. The liquid ink includes a solute dissolved or suspended in an ink solvent, namely, the moistening liquid 420. After the moistening liquid 420 has been removed from the moistened medium 42, the solute remains on the medium 42. In various aspects, the temperature of the warmed heating liquid 415 is less than a medium degradation temperature above which the medium 42 irreversibly degrades. In various aspects, the moistening liquid 415 is water or an alcohol In various aspects, the liquid-blocking barrier forms an outer surface of a liquid reservoir containing the heating liquid 415 such that the heating liquid 415 contacts the second surface of the liquid-blocking barrier. The moistened medium 42 is moved along a transport path which brings the moistened medium 42 into contact with the liquid-blocking barrier forming the outer surface of the liquid reservoir. The liquid-blocking barrier moves together with the moistened medium 42 while they are in contact. The liquid-blocking barrier can be a belt or the circumferential surface of a drum. In an example, the liquid-blocking barrier is the sidewall of a drum, and the moistened medium 42 is run against the drum to heat the moistened medium 42.

In various examples, the liquid-blocking barrier forms an outer surface of a heating belt. The heating belt includes a backing layer arranged with respect to the liquid-blocking barrier to form a sealed liquid cavity extending along the heating belt. For example, the belt can be shaped like an inner tube stretched normal to the plane of the inner tube. The liquid cavity contains the heating liquid 415 such that the heating liquid 415 contacts the second surface of the liquid-blocking barrier. In various aspects, the heating liquid 415 can undergo a phase changed, as described above. Solidification can be an exothermic process and the latent heat released can be used to help evaporate of the moistening liquid 420.

In various examples, the overall rate of crystallization on a liquid-to-solid phase change is kept sufficiently high to inhibit the growth of large crystals. The result is that the heating liquid 415 solidifies in the liquid cavity into a powder. The heating belt can thus move even though the heating liquid 415 has solidified, since motion of the heating belt will displace powder grains with respect to each other. In various aspects, this powder is produced by seeded crystallization. The liquid cavity contains a plurality of seed crystals. These seed crystals can be solid particulates of the same material as the heating liquid, and serve as nucleation sites for crystallization, hence solidification. The interior walls of the liquid cavity can also have nucleation sites protruding from them, e.g., a flexible, fuzzy structure.

In other aspects, the heating liquid 415 is very friable when it solidifies (e.g., wax). Motion of the heating belt can thus readily bend or break the solidified heating liquid 415, permitting normal motion of the belt even while the liquid cavity contains solidified heating liquid 415. These aspects, and those described above using powder, can apply to phase changes described throughout this disclosure.

In optional transport through reservoir step 832, which is part of contact heating liquid and barrier step 830, after the moistened medium 42 is brought into contact with the first surface of the liquid-blocking barrier, which provides a blocked region of the moistened medium 42, the blocked region is transported along a transport path through a liquid reservoir containing the heating liquid 415. The blocked region is submerged in the warmed heating liquid 415, thereby bringing the second surface of the liquid-blocking barrier into contact with the heating liquid 415.

In various aspects, the heating liquid 415 undergoes a phase change while heat is being transferred from the heating liquid 415 to the moistening liquid 420, as described above. The phase change releases heat such that at least a portion of the released heat contributes to vaporizing the moistening liquid 420. In various of these aspects, the rotatable liquid-blocking member is a liquid-blocking belt which travels along a belt path. At least some of the heating liquid 415 is solid after the phase change, and the belt path is arranged so that after the blocked region is transported through the liquid reservoir, solidified heating liquid 415 is dislodged from the liquid-blocking belt as the belt undergoes a change in surface orientation. This is as described above with respect to changes in surface orientation of the moistened medium 42; the same applies to the belt. When the belt changes surface orientation, the moistened medium 42 in contact therewith does also.

In optional absorb heating liquid into porous material step 834, which is part of contact heating liquid and barrier step 830, the heating liquid 415 is absorbed into a porous material. The porous material containing the absorbed hearing liquid 415 contacts the second surface of the liquid-blocking barrier. In various aspects, the porous material is permanently affixed to the second surface of the liquid-blocking barrier. For example, the liquid-blocking barrier can be a belt with an open-cell foam affixed (e.g., glued) to the side opposite the side that contacts the moistened medium 42. In various aspects, the porous material forms a porous belt that is brought into contact with the second surface of the liquid-blocking barrier. For example, the liquid-blocking barrier can be a belt, and a separate belt of foam can be brought into contact with the liquid-blocking barrier only in a region in which the moistened medium 42 contacts the liquid-blocking barrier.

In optional transport porous material through reservoir step 835, which is part of optional absorb heating liquid into porous material step 834, the porous material is transported through a liquid reservoir containing the heating liquid 415. The porous material in the reservoir absorbs the warmed heating liquid 415. This permits effectively transporting heat, in the form of warmed heating liquid 415, from a reservoir to a contact region in which the heat is transferred through the liquid-blocking barrier to the moistened medium 42.

In optional impinge warmed heating liquid on barrier step 836, which is part of contact heating liquid and barrier step 830, the second surface of the liquid-blocking barrier is brought into contact with the heating liquid 415 by using a liquid-delivery system to impinge the warmed heating liquid 415 onto the second surface of the liquid-blocking barrier. In various aspects, the warmed heating liquid 415 undergoes a phase change while heat is being transferred from the warmed heating liquid 415 to the moistening liquid 420, and the phase change releases heat such that at least a portion of the released heat contributes to vaporizing the moistening liquid 420 (as discussed above). In various of these aspects, the phase change is a liquid-to-solid phase change, or another exothermic phase change that releases heat. In various aspects, at least some of the heating liquid 415 is solid after the phase change. The rotatable liquid-blocking member is a liquid-blocking belt that travels along a belt path arranged such that solidified heating liquid 415 is dislodged from the liquid-blocking belt as the liquid-blocking belt undergoes a change in surface orientation. Changes in surface orientation are defined above.

Figure 9:
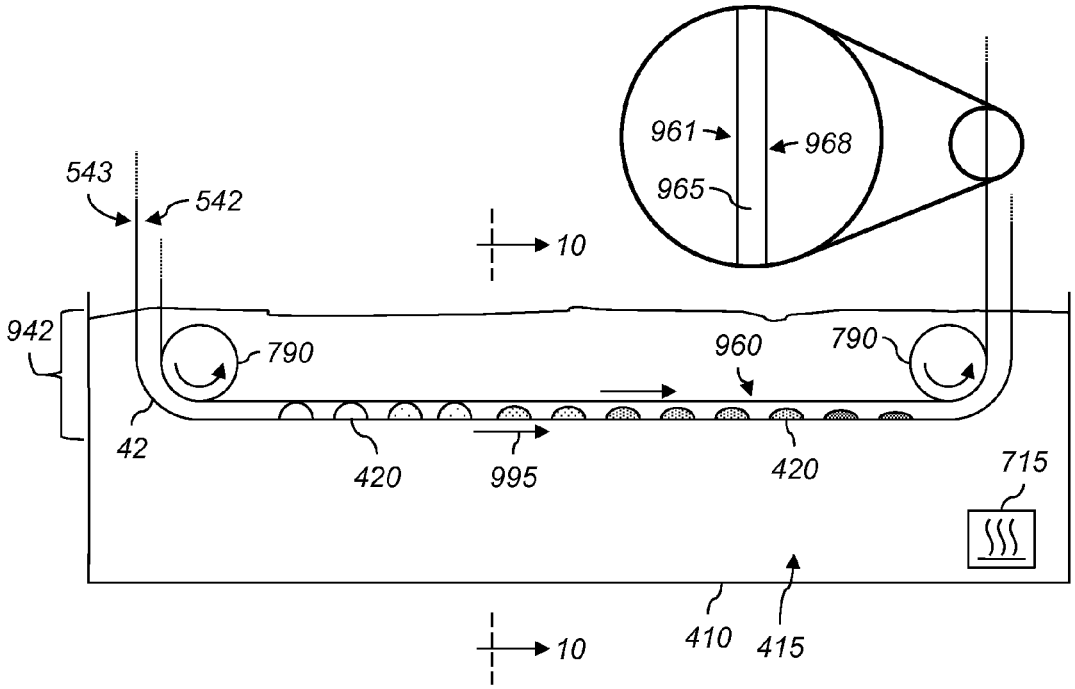
FIGS. 9 and 10 are side and front elevational cross-sections, respectively, of media drying systems for removing a moistening liquid from a moistened medium according to various aspects.

FIG. 9 is a side elevational cross-section of an exemplary media drying system for removing moistening liquid 420 from moistened medium 42 having surfaces 542, 543 (discussed above) according to various aspects. Moistening liquid 420 has a moistening-liquid boiling point. Liquid reservoir 410 contains heating liquid 415, as discussed above with respect to FIG. 4. Liquid-heating system 715 warms heating liquid 415 in liquid reservoir 410 to a temperature greater than the moistening-liquid boiling point, as discussed above with reference to FIG. 7.

Rotatable liquid-blocking member 960 has liquid-blocking layer 965 with inner surface 961 and outer surface 968. A media-transport system, in this example including rotatable members 790, transports moistened medium 42 along a transport path 995. Along the transport path 995, the moistened medium 42 is entrained around liquid-blocking member 960 so that surface 542 of moistened medium 42 is brought into contact with outer surface 968 of liquid-blocking layer 965. Liquid-blocking layer 965 can take many forms including a thin membrane, a sheet of metal (relatively more or relatively less flexible), or a polymer sheet or belt.

Liquid-blocking member 960 and liquid reservoir 410 are arranged so that entrained portion 942 of moistened medium 42 passes through liquid reservoir 410. Entrained portion 942 is thus submerged in warmed heating liquid 415. This can bring heating liquid 415 into contact with inner surface 961 of the liquid-blocking layer 965, so heat is transferred through liquid-blocking layer 965 from warmed heating liquid 415 to moistening liquid 420. This can also bring heating liquid 415 into contact with surface 543 of moistened medium 42, thereby transferring heat into moistened medium 42 to moistening liquid 420. In either situation, the heat transfer vaporizes the moistening liquid 420 and removes it from the moistened medium 42, represented graphically by the shrinking ellipsoidal drops of moistening liquid 420 (evaporation) and the increasingly-dense hatching of those drops (heating).

In various aspects, rotatable liquid-blocking member 960 is a drum that rotates around a central axis. Liquid-blocking layer 965 is a circumferential surface of the drum. In various aspects, rotatable liquid-blocking member 960 is a belt that is transported around a belt path.

In various aspects, liquid-blocking member 960 (including liquid-blocking layer 965) is permeable to the vaporized moistening liquid 420. In an example, liquid-blocking layer 965 is formed from GORE-TEX or a similar material that blocks liquid but is permeable to vapor.

In various aspects, warmed heating liquid 415 undergoes a phase change while heat is being transferred from warmed heating liquid 415 to moistening liquid 420, as discussed above. The phase change releases heat so that at least a portion of the released heat contributes to vaporizing moistening liquid 420. The phase change can be a liquid-to-solid phase change, or another exothermic phase change that releases heat.

In various aspects, moistened medium 42 includes a printed pattern formed using a liquid ink having a solute dissolved or suspended in an ink solvent. Moistening liquid 420 is the ink solvent. After moistening liquid 420 has been removed from moistened medium 42, the solute remains on moistened medium 42. In various of these aspects, moistening liquid 420 of the printed pattern is deposited on surface 542 of moistened medium 42. Liquid-blocking member 960 can prevent heating liquid 415 from contacting the printed pattern until moistening liquid 420 has at least partly evaporated. In various aspects, the temperature of warmed heating liquid 415 is less than a medium degradation temperature above which the medium 42 irreversibly degrades, as discussed above. Moistening liquid 420 can be, for example, water or an alcohol.

Figure 10:
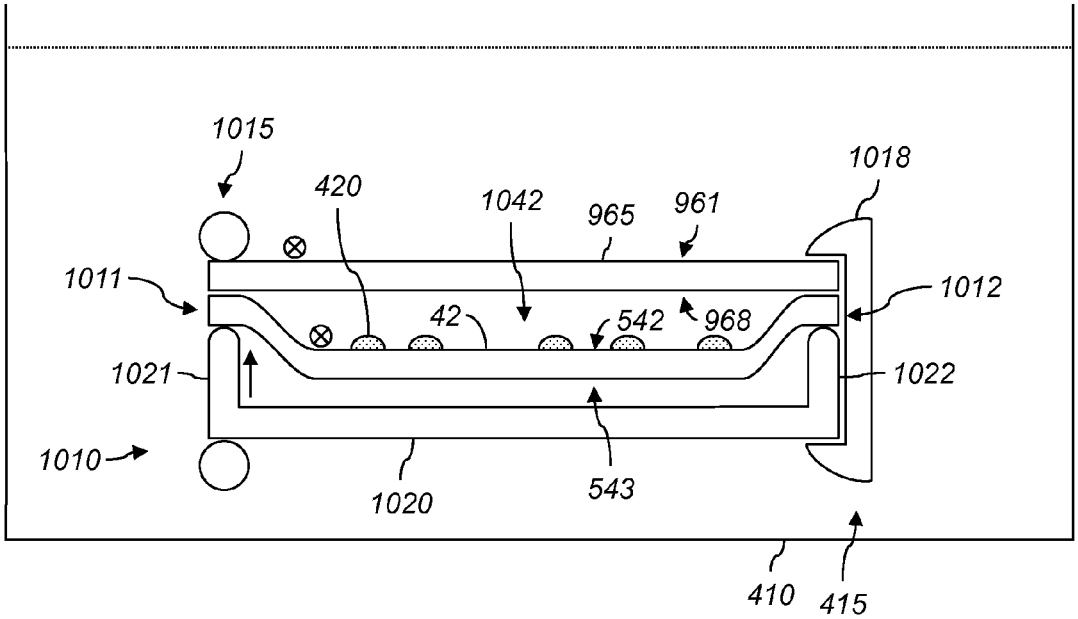

FIG. 10 shows a front elevational section along the line 10-10 in FIG. 9 according to various aspects. Liquid reservoir 410, heating liquid 415 (the top surface of which is represented by a broken line), moistened medium 42, moistening liquid 420, surfaces 542 and 543, liquid-blocking layer 965, inner surface 961 and outer surface 968 are as shown in FIG. 9. The transport path 995 (FIG. 9) of moistened medium 42 extends into the plane of the page, as indicated.

In various aspects, sealing mechanism 1010 seals edges 1011, 1012 of moistened medium 42 to liquid-blocking layer 965. In various of these aspects, sealing mechanism 1010 includes backing member 1020 that presses moistened medium 42 against outer surface 968 of the liquid-blocking layer 965. Backing member 1020 can include ribs 1021, 1022 that exert pressure on edges 1011, 1012 of moistened medium 42. In various aspects, backing member 1020 is a ribbed belt including one or more ribs at appropriate cross-track positions that press against moistened medium 42. This pressure presses corresponding portions of moistened medium 42 against liquid-blocking layer 965, enclosing lumen 1042 in which moistening liquid 420 is kept from contact with heating liquid 415. Backing member 1020 can be pressed against moistened medium 42 by a piston or shoe, or by the position of rollers around which it is entrained.

In various aspects, backing member 1020, moistened medium 42, and liquid-blocking layer 965 are pressed together and pulled together through a channel that exerts pressure on edges 1011, 1012 to seal lumen 1042, thereby substantially preventing the heating liquid 415 from directly contacting surface 542 of the moistened medium 42. Specifically, in various aspects, sealing mechanism 1010 includes edge-clamping mechanism 1015 (represented graphically as two circular cross-section portions of a band or tube; for clarity, only shown on one edge) that clamps edges 1011, 1012 of moistened medium 42 to liquid-blocking layer 965. Edge-clamping mechanism 1015 can also clamp an edge of backing member 1020 (as shown), or not. In various aspects, sealing mechanism 1010 includes one or more O-rings (not shown) arranged between the edges of the moistened medium 42 and the liquid-blocking layer 965. In various aspects, sealing mechanism 1010 includes edge seals 1018 that cover the edges of the moistened medium. For clarity, these are shown only on one edge, but they can be provided on both edges 1011, 1012 of medium 42. Edge seal 1018 can be a ribbed belt rotating around rollers on vertical axes. Edge seal 1018 can also cover an edge of backing member 1020 (as shown), or not.

In various aspects, heating liquid 415 is miscible with moistening liquid 420. Liquid-blocking layer 965 and moistened medium 42 form lumen 1042, as described above, so that heating liquid 415 is substantially unable to mix with or dissolve moistening liquid 420.

FIG. 11 is a side-elevational cross-section of an exemplary media drying system for removing moistening liquid 420 from moistened medium 42 having surfaces 542 and 543. Moistening liquid 420 has a moistening-liquid boiling point. Rotatable heating member 1160 is provided, which in this example is a partially-hollow drum arranged to rotate around axis 1116. Rotatable heating member 1160 includes liquid-blocking layer 1165 with inner surface 1161 and outer surface 1168. Backing layer 1175 is affixed to liquid-blocking layer 1165 to define a liquid cavity 1115 between the liquid-blocking layer 1165 and the backing layer 1175. Liquid cavity 1115 does not include axis 1116. That is, axis 1116 passes through a region of space not included in liquid cavity 1115. Liquid cavity 1115 is at least partially filled with heating liquid 415 sealed between liquid-blocking layer 1165 and backing layer 1175 so that heating liquid 415 is in contact with inner surface 1161 of liquid-blocking layer 1165.

Liquid-heating system 715, represented graphically here, warms heating liquid 415 in liquid cavity 1115 to a temperature greater than the moistening-liquid boiling point, as represented graphically by the dark hatching. Liquid-heating system 715 can include a resistive or other type of heater, as described above. Heating liquid 415 can completely fill liquid cavity 1115 or not. In various aspects, the rotation of rotatable heating member 1160, or vanes or other structures inside liquid cavity 1115, mixes heating liquid 415 in liquid cavity 1115 to provide a substantially uniform temperature along the width of rotatable heating member 1160 (in and out of the page, in this figure). Various aspects advantageously use the heat-transport capability of heating liquid 415 to apply heat to moistening liquid 420 without requiring a large amount of heating liquid 415, and therefore without requiring as much heat or time to heat as a larger amount of heating liquid 415. The use of liquid-blocking layer 1165 can reduce degradation of an image formed from drops of moistening liquid 420 (e.g., ink).

A media-transport system, e.g., including rotatable members 790 (e.g., belts or drums, or a belt entrained around multiple drums), transports moistened medium 42 along a transport path 1195 in which moistened medium 42 contacts or is entrained around rotatable heating member 1160 so that surface 542 of moistened medium 42 is brought into contact with outer surface 1168 of liquid-blocking layer 1165. Heat is transferred through liquid-blocking layer 1165 from warmed heating liquid 415 to moistening liquid 420, thereby vaporizing moistening liquid 420 and removing it from moistened medium 42. Liquid-blocking layer 1165 can be a thin membrane, a metal layer, or other layer types described herein.

In various aspects, rotatable heating member 1160 is a belt that is transported around a belt path. In an example, rotatable heating member 1160 is entrained around two rollers and the belt path passes around those rollers and along an approximately straight line between them. Axis 1116 passes through an interior of the belt path, e.g., between the two rollers. In various aspects, a backing member 1180 presses moistened medium 42 against the outer surface 1168 of the liquid-blocking layer 1165 of rotatable heating member 1160. Backing member 1180 can be a shoe, belt, drum, wedge, piston, or other device for pressing.

In various aspects, liquid-heating system 715 warms heating liquid 415 by conduction or radiation. For example, liquid-heating system 715 can include a resistor or other electrical heating element arranged in liquid cavity 1115, either rotating with rotatable heating member 1160 or not. In various aspects, liquid-heating system 715 warms heating liquid 415 external to rotatable heating member 1160. Liquid-heating system 715 then circulates warmed heating liquid 415 through liquid cavity 1115 in rotatable heating member 1160.

In an example, rotatable heating member 1160 is a drum that is toroidal in cross-section, mounted at one end of axis 1116. The other end has a plate that can remain stationary while the drum rotates. That plate is sealed around the edges and forms part of liquid-blocking layer 1165. The plate has an inlet and an outlet, and the outlet is below the inlet. Liquid-heating system 715 pumps warmed heating liquid 415 into the inlet, and pumps heating liquid 415 that has transferred some heat to moistening liquid 420 out the outlet.

In various aspects, moistened medium 42 includes a printed pattern formed using a liquid ink, the liquid ink including a solute dissolved or suspended in an ink solvent, moistening liquid 420 being the ink solvent, as discussed above. After moistening liquid 420 has been removed from moistened medium 42, the solute remains on medium 42. In various aspects, the temperature of warmed heating liquid 415 is less than a medium degradation temperature above which the medium 42 irreversibly degrades. In various aspects, moistening liquid 420 is water or an alcohol.

FIG. 12 is an elevational cross-section of an exemplary media drying system for removing moistening liquid 420 from moistened medium 42 having surfaces 542 and 543 according to various aspects, the moistening liquid 420 having a moistening-liquid boiling point. Liquid reservoir 410 contains heating liquid 415. Liquid-heating system 715 warms heating liquid 415 in liquid reservoir 410 to a temperature greater than the moistening-liquid boiling point.

Rotatable liquid-blocking member 1260 has liquid-blocking layer 1165 with inner surface 1161 and outer surface 1168, as discussed above. A media-transport system, (e.g., including rotatable members 790 such as belts or drums, or a belt entrained around multiple drums), transports moistened medium 42 along a transport path 1295 in which moistened medium 42 contacts, or is entrained around, liquid-blocking member 1260 in contact zone 1270. Surface 542 of moistened medium 42 is thus brought into contact with outer surface 1168 of liquid-blocking layer 1165. Backing members (e.g., backing member 1180 shown in FIG. 11) can optionally be used to press the moistened medium 42 against the liquid-blocking layer 1165.

Porous material 1280, represented graphically as spheres adjacent to inner surface 1161, absorbs heating liquid 415 from liquid reservoir 410 so that the heating liquid 415 in porous material 1280 is brought into contact with inner surface 1161 of liquid-blocking layer 1165 for at least part of contact zone 1270, and optionally elsewhere. This is represented graphically by the darkening hatching as rotatable liquid-blocking member 1260 rotates clockwise (in this example), carrying portions of porous material 1280 through heating liquid 415. In this manner, porous material 1280 and the heating liquid 415 absorbed or otherwise contained therein are then carried towards moistened medium 42. In contact zone 1270, heat is transferred through liquid-blocking layer 1165 from the absorbed warmed heating liquid 415 to moistening liquid 420. This is represented graphically by the dark hatching on moistening liquid 420 leaving contact zone 1270, fading gradually as moistening liquid 420 cools. This can vaporize moistening liquid 420 and remove it from moistened medium 42. Evaporation of moistening liquid 420 is represented graphically by the reduction in size of drops of moistening liquid 420 left to right through the contact zone 1270 and continuing to the right.

In the example shown, liquid-blocking layer 1165 is a rotatable cylinder or drum at least partly open at the ends, or including pores or voids through which heating liquid 415 can pass. Rotatable heating member 1160 rotates around a central axis (not shown). Porous material 1280 is permanently affixed (e.g., glued) to inner surface 1161 of liquid-blocking layer 1165. A lower portion of the drum (liquid-blocking member 1260) is submerged in heating liquid 415 in liquid reservoir 410. The drum (liquid-blocking member 1260) rotates to transport heating liquid 415 absorbed in porous material 1280 from liquid reservoir 410 to moistened medium 42, where it surrenders heat to moistening liquid 420 in contact zone 1270, which corresponds to an upper portion of the drum (liquid-blocking member 1260). The absorbed heating liquid 415 itself remains in porous material 1280. The cooled heating liquid 415 in porous material 1280 then travels back to liquid reservoir 410 to be reheated or replaced by heated heating liquid 415.

In various aspects, dryer 1285 (e.g., shown as a roller nip), squeezes or wrings porous material 1280, or otherwise removes cooled heating liquid 415 from porous material 1280, after the heat is transferred to moistening liquid 420. This removal permits porous material 1280 to readily absorb fresh, hot heating liquid 415 in liquid reservoir 410. Heating liquid 415 removed from porous material 1280 can be returned to liquid reservoir 410 for re-heating. Returning can be accomplished by positioning dryer 1285 to drip the removed heating liquid 415 directly into liquid reservoir 410, as shown, or by transporting removed heating liquid 415 through a liquid transport (e.g., a pump).

In various aspects, rotatable liquid-blocking member 1260 is a drum that rotates around a central axis (not shown). Liquid-blocking layer 1165 is a circumferential surface of the drum and liquid reservoir 410 is contained within the drum. This permits using less liquid, since the liquid can fill only part of the drum (liquid-blocking member 1260), and reduces heat loss compared to a liquid reservoir in which a significant surface area of heating liquid 415 is exposed to air or another atmosphere or environment cooler than heating liquid 415.

Figure 13:
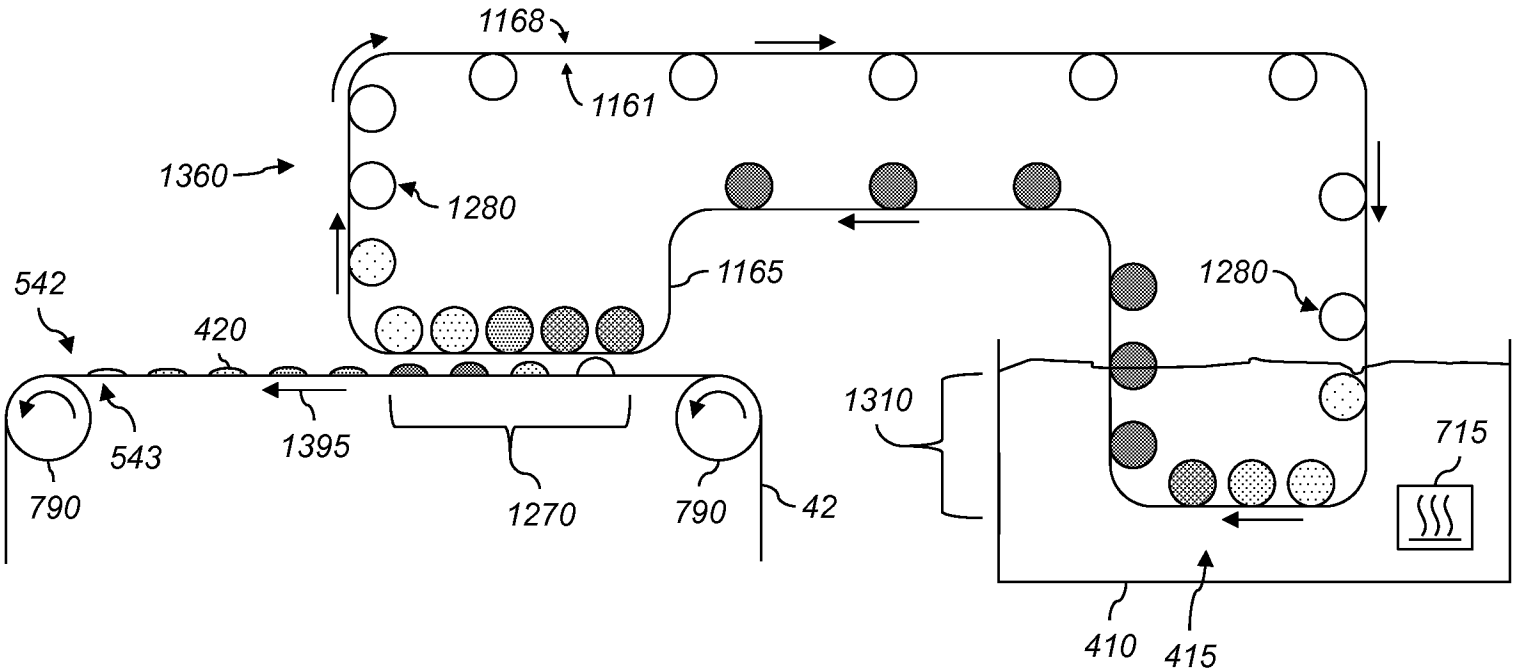

FIG. 13 is an elevational cross-section of an exemplary media drying system for removing moistening liquid 420 from moistened medium 42 according to various aspects. Moistening liquid 420, moistened medium 42, surfaces 542 and 543, liquid reservoir 410, heating liquid 415, liquid-heating system 715, liquid-blocking layer 1165, inner surface 1161, outer surface 1168, rotatable members 790 of a media-transport system, and contact zone 1270 are as shown above. In this example, rotatable liquid-blocking member 1360 is a belt that is transported around a belt path. Porous material 1280 is as described above. For clarity, not all porous material is expressly shown. Also for clarity, the rotatable members around which rotatable liquid-blocking member 1360 is entrained are not shown. In an example, rotatable liquid-blocking member 1360 is entrained around several roller pairs. Each roller pair includes two rollers on respective axially-aligned shafts, or on a single shaft. One roller supports a left edge of the belt and one that supports a right edge of the belt. Porous material 1280 passes laterally between the rollers of each pair without being substantially compressed.

A media-transport system, (e.g., including rotatable members 790 such as belts or drums, or a belt entrained around multiple drums), transports moistened medium 42 along a transport path 1395 in which moistened medium 42 contacts, or is entrained around, rotatable liquid-blocking member 1360 in contact zone 1270.

In various aspects, the belt (rotatable liquid-blocking member 1360) is submerged in heating liquid 415 in liquid reservoir 410 for path portion 1310 of the belt path. This permits the porous material 1280 to absorb or otherwise capture heating liquid 415. The rotatable liquid-blocking member 1360 moves around the belt path to transport absorbed heating liquid 415 to contact zone 1270. This advantageously permits using a wide variety of printer geometries, since the transport path 1395 of moistened medium 42 can be positioned many different places with respect to liquid reservoir 410.

Figure 14:
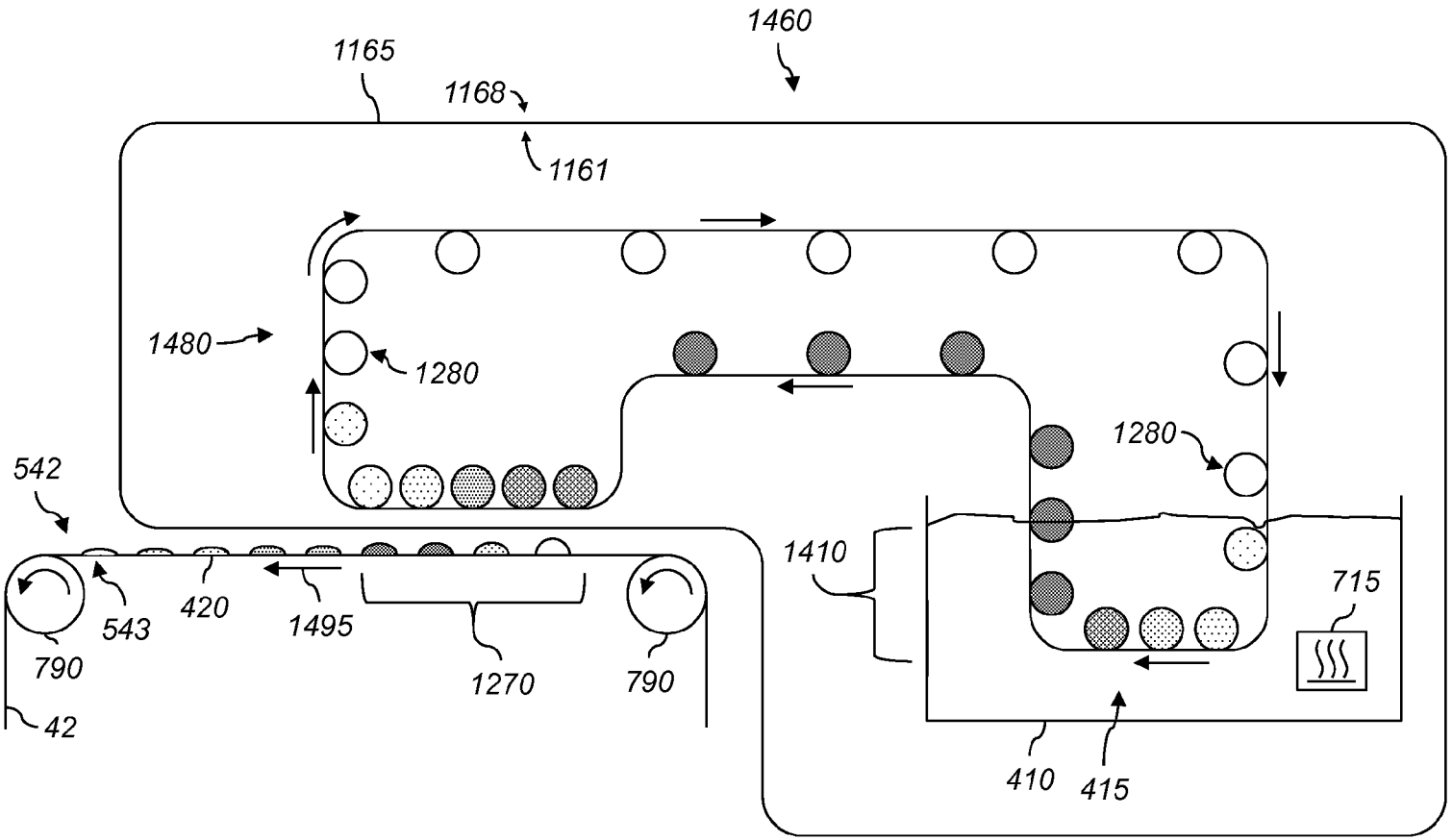

FIG. 14 is an elevational cross-section of an exemplary media drying system for removing moistening liquid 420 from moistened medium 42 according to various aspects. Moistening liquid 420, moistened medium 42, surfaces 542 and 543, liquid reservoir 410, heating liquid 415, liquid-heating system 715, liquid-blocking layer 1165, inner surface 1161, outer surface 1168, rotatable members 790 of a media-transport system, transport path 1495 and contact zone 1270 are as shown above. Rotatable liquid-blocking member 1460 is a belt that is transported around a belt path. For clarity, the rotatable members around which rotatable liquid-blocking member 1460 is entrained are not shown. In an example, rotatable liquid-blocking member 1460 is entrained around roller pairs, as described above Porous material 1280 forms porous belt 1480 that is transported around a porous belt path. Porous belt 1480 is brought into contact with inner surface 1161 of liquid-blocking layer 1165 for a portion of the porous belt path corresponding to at least a portion of contact zone 1270. In various aspects, porous belt 1480 is transported through liquid reservoir 410 containing heating liquid 415 during path portion 1410 of the porous belt path. In the path portion 1410, porous material 1280 absorbs warmed heating liquid 415.

Various aspects in which porous belt 1480 and rotatable liquid-blocking member 1460 are only in contact in the first portion of the porous belt bath can advantageously reduce heat loss due to conduction into rotatable liquid-blocking member 1460.

In various aspects, the warmed heating liquid undergoes a phase change while heat is being transferred from the warmed heating liquid to the moistening liquid. As described herein, the phase change releases heat such that at least a portion of the released heat contributes to vaporizing the moistening liquid. The phase change can be a liquid-to-solid phase change, or another exothermic phase change that releases heat. The powder examples described above can be used. Heating liquid 415 in the pores of porous belt 1480 solidifies into grains of a powder, which then melt into a liquid in liquid reservoir 410.

In various aspects, as discussed above, moistened medium 42 includes a printed pattern formed using a liquid ink, the liquid ink including a solute dissolved or suspended in an ink solvent, moistening liquid 420 being the ink solvent. After moistening liquid 420 has been removed from moistened medium 42, the solute remains on the medium 42. In various aspects, the temperature of warmed heating liquid 415 is less than a medium degradation temperature above which the medium 42 irreversibly degrades. The moistening liquid 420 can, for example, be water or an alcohol.

Figure 15:
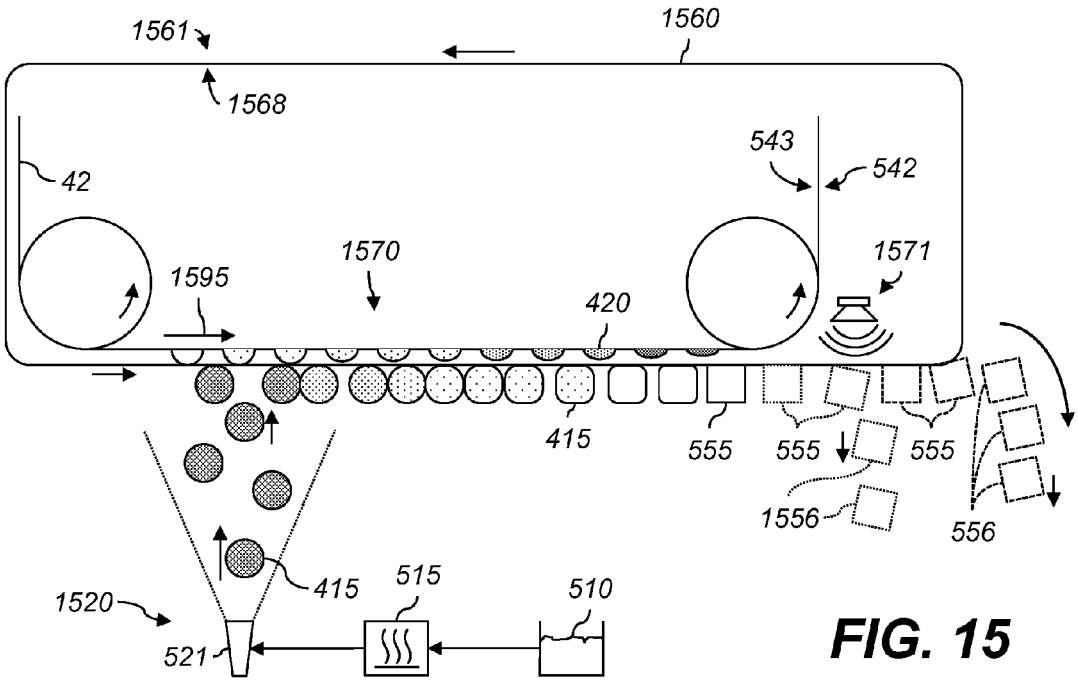
Figure 16:
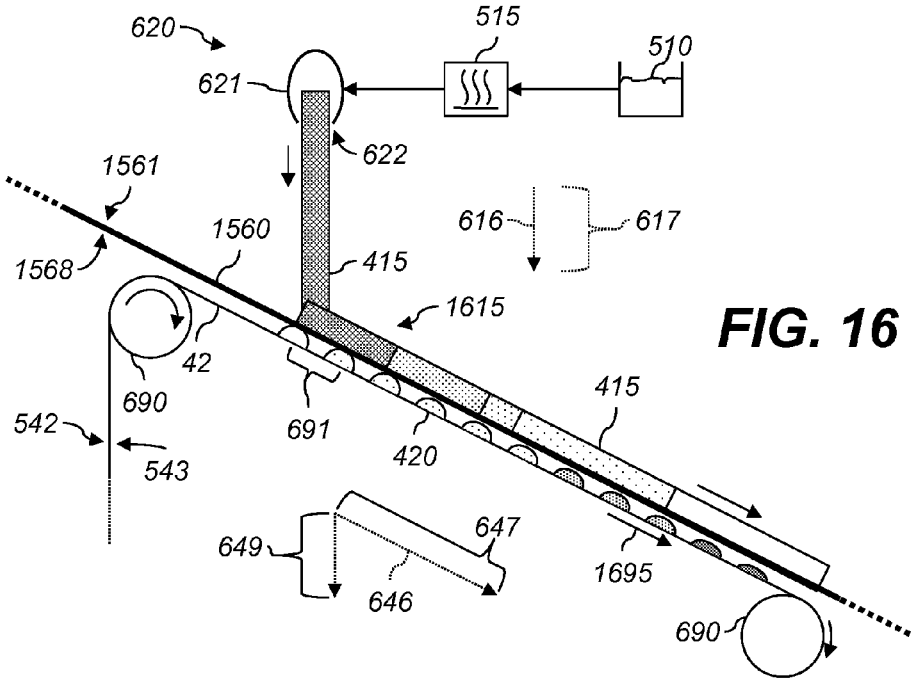
Figure 17:
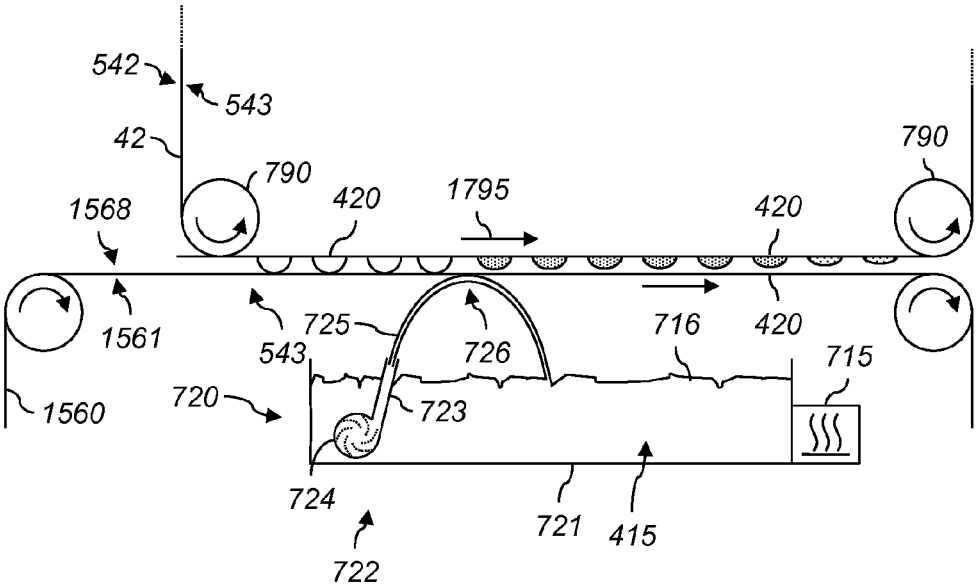

FIGS. 15-17 are elevational cross-sections of exemplary media drying systems for removing moistening liquid 420 from moistened medium 42 having surfaces 542 and 543, the moistening liquid 420 having a moistening-liquid boiling point. In various aspects, the moistened medium 42 includes a printed pattern, as described above. In various aspects, the temperature of warmed heating liquid 415 is less than a medium degradation temperature above which the medium 42 irreversibly degrades. Moistening liquid 420 can, for example, be water or an alcohol.

Referring to FIG. 15, liquid-supply system 510, liquid-heating system 515, and spraying system 521 are as shown in FIG. 5. Rotatable liquid-blocking member 1560 has inner surface 1561 and outer surface 1568. For clarity, the rollers, belts, or other members moving liquid-blocking member 1560 are not shown (e.g., four drums at the four corners shown). The media-transport system (e.g., rollers moving moistened medium 42) transports moistened medium 42 along a transport path 1595 in which surface 542 of moistened medium 42 is brought into contact with outer surface 1568 of liquid-blocking member 1560 in contact zone 1570. Liquid-delivery system 1520 impinges warmed heating liquid 415 onto inner surface 1561 of liquid-blocking member 1560 so that heat is transferred through liquid-blocking member 1560 from heating liquid 415 to moistening liquid 420, thereby vaporizing moistening liquid 420 and removing it from the moistened medium 42. In the example shown, liquid-delivery system 1520 includes spraying system 521 for spraying warmed heating liquid 415 onto inner surface 1561 of liquid-blocking member 1560, as described above with reference to FIG. 5. Heat is represented by hatching, as described above.

In various examples, warmed heating liquid 415 undergoes a phase change while heat is being transferred from warmed heating liquid 415 to moistening liquid 420. The phase change releases heat such that at least a portion of the released heat contributes to vaporizing moistening liquid 420. This is represented graphically by the transition of drops of heating liquid 415, represented as circles, to solidified heating liquid 555, represented as squares. The phase change can be a liquid-to-solid phase change or another exothermic phase change that releases heat.

In various aspects, at least some of the heating liquid is solid after the phase change (solidified heating liquid 555). Rotatable liquid-blocking member 1560 is a liquid-blocking belt that travels along a belt path. The belt path is arranged so that solidified heating liquid 555 is dislodged from the liquid-blocking member 1560 as it undergoes a change in surface orientation, as described above. This is represented graphically as detached solidified heating liquid 556.

In various aspects, liquid-blocking member 1560 is agitated to dislodge solidified heating liquid 555. This is represented graphically by detached solidified heating liquid 1556. Agitation can be performed by agitator 1571(represented graphically using a speaker symbol). For example, the agitator 1571 can be an oscillatory mechanical transducer, such as an ultrasonic transducer or a motor driving an off-balance counterweight.

Referring to FIG. 16, liquid-supply system 510, liquid-heating system 515, liquid-delivery system 620, curtain-coating system 621, slit 622, moistened medium 42, moistening liquid 420, heating liquid 415, media-transport system including rotatable transport members 690, coating region 691, liquid-curtain speed 617, liquid-curtain direction 616, medium-transport speed 647, medium-transport direction 646, and speed component 649 are as shown in FIG. 6. Warmed heating liquid 415 flows through slit 622, thereby forming liquid curtain 1615 that impinges on inner surface 1561 of liquid-blocking member 1560. Outer surface 1568 of liquid-blocking member 1560 is in contact with moistened medium 42, which is being moved along transport path 1695. Heat is transferred from the warmed heating liquid 415 through the liquid-blocking member 1560 to moistening liquid 420, thereby vaporizing moistening liquid 420 and removing it from the moistened medium 42.

In various aspects, the warmed heating liquid undergoes a phase change, as described above. In various aspects, speed component 649 of the transported moistened medium 42 in liquid-curtain direction 616 is within ±20% of liquid-curtain speed 617 at a point in coating region 691, as described above.

Referring to FIG. 17, moistened medium 42, surfaces 542 and 543, moistening liquid 420, media-transport system including rotatable members 790, liquid-heating system 715, liquid-delivery system 720, liquid tank 721, wave-forming system 722, nozzle 723, pump 724, stationary wave 725, peak 726, top surface 716, and heating liquid 415 are as shown in FIG. 7. Rotatable liquid-blocking member 1560 has inner surface 1561 and outer surface 1568. Peak(s) 726 of stationary wave 725 impinge on inner surface 1561 of liquid-blocking member 1560. Outer surface 1568 of liquid-blocking member 1560 is in contact with moistened medium 42, which is being moved along transport path 1795. Heat is transferred from the warmed heating liquid 415 through the liquid-blocking member 1560 to moistening liquid 420, thereby vaporizing moistening liquid 420 and removing it from the moistened medium 42.

Figure 18:
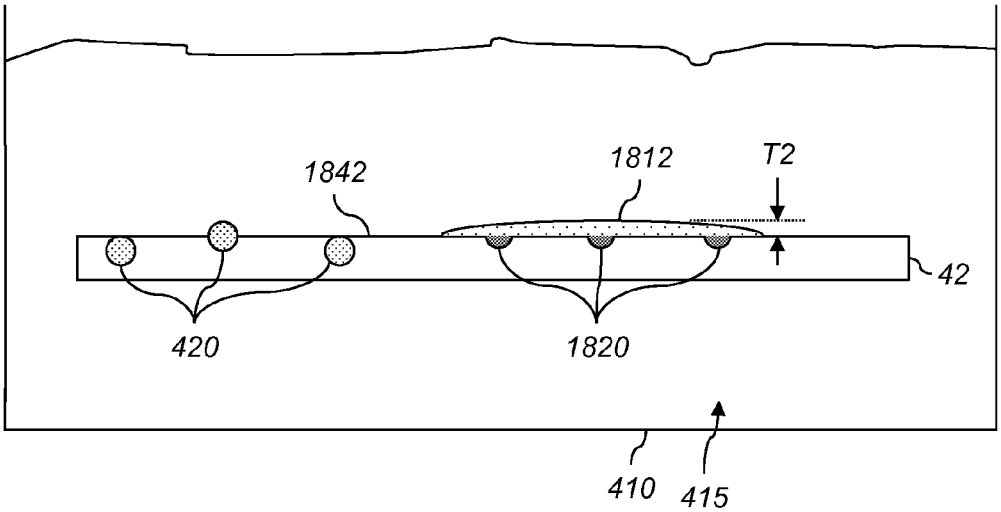
FIG. 18 is a cross-section showing an example of the Leidenfrost effect.

FIG. 18 is a cross-section showing an example of the Leidenfrost effect. Moistened medium 42 has moistening liquid 420 (shown hatched) therein or thereon, and is submerged (in this example) in heating liquid 415 in liquid reservoir 410. Drops 1820 are evaporating due to heat transfer from heating liquid 415. This evaporation forms vapor layer 1812. Vapor layer 1812 pushes heating liquid 415 away from surface 1842 of moistened medium 42. Heat conductance across vapor layer 1812 varies inversely to its thickness T2. Therefore, in various aspects, the pressure of heating liquid 415 near vapor layer 1812 is increased to compress the vapor, reducing T2 and increasing the thermal conductance across vapor layer 1812.

The invention is inclusive of combinations of the aspects or aspects described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred aspects and aspects thereof, but it will be understood that variations, combinations, and modifications can be effected by a person of ordinary skill in the art within the spirit and scope of the invention.

PARTS LIST

39 dried image
40 supply unit
42 medium
42A, 42B, 42C, 42D, 42X receiver
60 dryer
64 drying roller
70A, 70B marking engine
71 ink manifold
72 heater
76 nozzle
77, 77B ink drop
78 ink image
90 finisher
91 output tray
95 transport web
96 cleaning station
99 logic and control unit
100 printer
310 contact liquid and surface step
320 transport medium through reservoir step
321 shallow-angle transport step
322 superheat moistening liquid step
323 agitate heating liquid step
330 impinge heating liquid step
331 move medium step
332 impinge wave on medium step
401 environment
410 liquid reservoir
412 slit
415 heating liquid
416 top surface
420 moistening liquid
421 bubble
422, 423 drop
425 first side
429 pattern
431 lower zone
439 upper zone
444 transducer
450 pressurizer
451 impeller
453 jet
456 pressure zone
458 directing member
459 pump
490A rotatable member
495 transport path
510 liquid-supply system
515 liquid-heating system
520 liquid-delivery system
521 spraying system
530 roller
542, 543 surface
555 solidified heating liquid
556 detached solidified heating liquid
595 transport path
599 drop
615 liquid curtain
616 liquid-curtain direction
617 liquid-curtain speed
620 liquid-delivery system
621 curtain-coating system
622 slit
646 medium-transport direction
647 medium-transport speed
649 speed component
690 rotatable transport member
691 coating region
695 transport path
715 liquid-heating system
716 top surface
720 liquid-delivery system
721 liquid tank
722 wave-forming system
723 nozzle
724 pump
725 stationary wave
726 peak
790 rotatable member
795 transport path
810 provide barrier step
820 contact surface and barrier step
830 contact heating liquid and barrier step
832 transport through reservoir step
834 absorb heating liquid into porous material step
835 transport porous material through reservoir step
836 impinge warmed heating liquid on barrier step
942 entrained portion

960 liquid-blocking member
961 inner surface
965 liquid-blocking layer
968 outer surface
995 transport path
1010 sealing mechanism
1011, 1012 edge
1015 edge-clamping mechanism
1018 edge seal
1020 backing member
1021, 1022 rib
1042 lumen
1115 liquid cavity
1116 axis
1160 rotatable heating member
1161 inner surface
1165 liquid-blocking layer
1168 outer surface
1175 barrier layer
1180 backing member
1195 transport path
1260 liquid-blocking member
1270 contact zone
1280 porous material
1285 dryer
1295 transport path
1310 path portion
1360 rotatable liquid-blocking member
1395 transport path
1410 path portion
1460 rotatable liquid-blocking member
1480 porous belt
1495 transport path
1520 liquid delivery system
1556 detached solidified heating liquid
1560 liquid-blocking member
1561 inner surface
1568 outer surface
1570 contact zone
1571 agitator
1595 transport path
1615 liquid curtain
1695 transport path
1795 transport path
1812 vapor layer
1820 drop
1842 surface
T, T2 thickness
θ angle

The invention claimed is:

1. A media drying system for removing a moistening liquid from a moistened medium having a first surface and a second surface, the moistening liquid having a moistening-liquid boiling point, comprising:

a liquid reservoir containing a heating liquid;

a liquid-heating system for warming the heating liquid in the liquid reservoir to a temperature greater than the moistening-liquid boiling point;

a rotatable liquid-blocking member having a liquid-blocking layer with an inner surface and an outer surface; and a media-transport system for transporting the moistened medium along a transport path in which the moistened medium is entrained around the liquid-blocking member so that the first surface of the moistened medium is brought into contact with the outer surface of the liquid-blocking layer;

wherein the liquid-blocking member and the liquid reservoir are arranged so that an entrained portion of the moistened medium passes through the liquid reservoir, whereby the entrained portion is submerged in the warmed heating liquid bringing the heating liquid into contact with the inner surface of the liquid-blocking layer, such that heat is transferred through the liquid-blocking layer from the warmed heating liquid to the moistening liquid, or heat is transferred from the warmed heating liquid to the second surface of the moistened medium, thereby vaporizing the moistening liquid and removing it from the moistened medium.

2. The media drying system of claim 1 wherein the rotatable liquid-blocking member is a drum which rotates around a central axis, and wherein the liquid-blocking layer is a circumferential surface of the drum.

3. The media drying system of claim 1 wherein the rotatable liquid-blocking member is a belt that is transported around a belt path.

4. The media drying system of claim 1 further including a sealing mechanism to seal edges of the moistened medium to the liquid-blocking layer.

5. The media drying system of claim 4 wherein the sealing mechanism includes a backing member that presses the moistened medium against the liquid-blocking layer.

6. The media drying system of claim 5 wherein the backing member includes ribs that exert pressure on the edges of the moistened medium.

7. The media drying system of claim 4 wherein the sealing mechanism includes an edge-clamping mechanism that clamps the edges of the moistened medium to the liquid-blocking layer.

8. The media drying system of claim 4 wherein the sealing mechanism includes edge seals that cover the edges of the moistened medium.

9. The media drying system of claim 1 wherein the liquid-blocking barrier is permeable to the vaporized moistening liquid.

10. The media drying system of claim 1 wherein the warmed heating liquid undergoes a phase change while heat is being transferred from the warmed heating liquid to the moistening liquid, and wherein the phase change releases heat such that at least a portion of the released heat contributes to vaporizing the moistening liquid.

11. The media drying system of claim 10 wherein the phase change is a liquid-to-solid phase change.

12. The media drying system of claim 1 wherein the moistened medium includes a printed pattern formed using a liquid ink, the liquid ink including a solute dissolved or suspended in an ink solvent, the moistening liquid being the ink solvent, and wherein after the moistening liquid has been removed from the moistened medium the solute remains on the medium.

13. The media drying system of claim 12 wherein the moistening liquid of the printed pattern is deposited on the first surface of the moistened medium.

14. The media drying system of claim 1 wherein the heating liquid is miscible with the moistening liquid.

15. The media drying system of claim 1 wherein the temperature of the warmed heating liquid is less than a medium degradation temperature above which the medium irreversibly degrades.

16. The media drying system of claim 1 wherein the moistening liquid is water or an alcohol.

* * * * *